US008832895B2

(12) United States Patent
Jungnickel et al.

(10) Patent No.: US 8,832,895 B2
(45) Date of Patent: Sep. 16, 2014

(54) FORCE SENSING ORAL CARE INSTRUMENT

(75) Inventors: Uwe Jungnickel, Koenigstein/Taunus (DE); Niclas Altmann, Schoeneck (DE); René Guebler, Friedberg (DE)

(73) Assignee: Braun GmbH, Kronberg (DE)

( * ) Notice: Subject to any disclaimer, the term of this patent is extended or adjusted under 35 U.S.C. 154(b) by 276 days.

(21) Appl. No.: 13/237,456

(22) Filed: Sep. 20, 2011

(65) Prior Publication Data

US 2012/0110763 A1 May 10, 2012

Related U.S. Application Data

(60) Provisional application No. 61/384,485, filed on Sep. 20, 2010.

(51) Int. Cl.
*A46B 15/00* (2006.01)
*A46B 5/00* (2006.01)

(52) U.S. Cl.
CPC ..... *A46B 15/0002* (2013.01); *A46B 15/0012* (2013.01); *A46B 15/0044* (2013.01); *A46B 5/0062* (2013.01); *A46B 2200/1066* (2013.01)
USPC ..... 15/105; 15/167.1

(58) Field of Classification Search
CPC ..... A46B 5/0062; A46B 15/0002; A46B 15/0012; A46B 15/0038–15/0046
USPC ..... 15/105, 22.1, 167.1, 172, 144.1
See application file for complete search history.

(56) References Cited

U.S. PATENT DOCUMENTS

| | | | | | |
|---|---|---|---|---|---|
| 3,493,991 | A | * | 2/1970 | De Bianchi | 15/143.1 |
| 4,476,604 | A | * | 10/1984 | White et al. | 15/105 |
| 5,054,154 | A | * | 10/1991 | Schiffer et al. | 15/167.1 |
| 5,105,499 | A | * | 4/1992 | Dirksing | 15/167.1 |
| 5,282,291 | A | * | 2/1994 | Spieler et al. | 15/167.1 |
| 5,315,732 | A | * | 5/1994 | Huefner et al. | 15/167.1 |
| 5,355,544 | A | * | 10/1994 | Dirksing | 15/105 |
| 5,692,260 | A | * | 12/1997 | Haiduk | 15/167.1 |

(Continued)

FOREIGN PATENT DOCUMENTS

| | | | | | |
|---|---|---|---|---|---|
| DE | 44 20 738 | C1 | | 10/1995 | |
| GB | 2413268 | A | | 10/2005 | |
| JP | H10215950 | A | * | 8/1998 | A46B 5/00 |
| WO | WO 00/44259 | | | 8/2000 | |

OTHER PUBLICATIONS

International Search Report for PCT/IB2011/052324, dated Sep. 20, 2010.

*Primary Examiner* — Mark Spisich
*Assistant Examiner* — Andrew A Horton
(74) *Attorney, Agent, or Firm* — John P. Colbert; George H. Leal

(57) ABSTRACT

An oral hygiene implement for evaluating applied force is described herein. The oral hygiene implement has a handle region, a head, and a neck extending between the handle region and the head. The head has a plurality of cleaning elements attached to the head. The handle region has a first portion and a second portion and a force sensor pivotally connected to the first portion and the second portion. The force sensor includes the head and the neck and at least a portion of the force sensor is integrally formed with the first portion and/or the second portion.

13 Claims, 18 Drawing Sheets

(56) References Cited

U.S. PATENT DOCUMENTS

| | | | | |
|---|---|---|---|---|
| 5,815,872 | A | 10/1998 | Menginniss, III | |
| 6,330,730 | B1 * | 12/2001 | Davies et al. | 15/167.1 |
| 6,389,636 | B1 * | 5/2002 | Savill | 15/167.1 |
| 6,397,424 | B1 * | 6/2002 | Leung | 15/105 |
| 6,611,984 | B1 * | 9/2003 | Halm | 15/167.1 |
| 7,281,289 | B1 * | 10/2007 | Mirza et al. | 15/167.1 |
| 7,526,828 | B2 * | 5/2009 | Kniese | 15/167.1 |
| 2008/0264327 | A1 * | 10/2008 | Pett et al. | 116/212 |
| 2009/0320225 | A1 * | 12/2009 | Wu et al. | 15/167.1 |

* cited by examiner

FORCE SENSING ORAL CARE INSTRUMENT

CROSS REFERENCE OF RELATED APPLICATION

This application claims the benefit of provisional application Ser. No. 61/384,485, filed on Sep. 20, 2010, which is incorporated by reference in its entirety herein.

FIELD OF THE INVENTION

The present invention pertains to a personal hygiene device, more particularly to a personal hygiene device including a force indication system.

BACKGROUND OF THE INVENTION

The utilization of toothbrushes to clean one's teeth has long been known. During the brushing process, a user generally applies a force to the brush which is applied against the teeth and gums by the cleaning elements of the toothbrush. A minimum level of force must be applied to remove plaque and debris; however, high levels of force may have negative health consequences for an individual. For example, issues such as gum irritation, or over periods of time, gum recession or tooth enamel abrasion may occur. Unfortunately, the presence of these issues may exacerbate a contributing factor to the issues, i.e. high brushing force. Because some users may feel that these issues stem from poor cleaning, in an effort to correct the issues the users may apply even more force during brushing which in turn may cause more gum irritation and/or gum recession or tooth enamel abrasion.

In order to avoid or mitigate these issues, dental professionals may recommend the use of a soft bristled toothbrush. However, the use of a soft bristled toothbrush does not preclude the application of high brushing forces to the oral cavity. Furthermore, it is extremely difficult for an individual, when brushing, to determine the optimal force required for cleaning. While a user may apply a minimum level of force to enable cleaning, feeling the level at which the force is too high is difficult. In addition, studies have shown that the cleaning ability of a toothbrush may in fact be reduced if brushing force is increased to too high a level.

Other recommended solutions may be to apply less force while brushing. However, if too little force is applied during brushing, the cleaning efficacy of the toothbrush often can be reduced. Furthermore, similar to high brushing forces, the individual may find it difficult to determine when brushing forces are too low.

Accordingly, a need exists for a personal hygiene implement which signals to the user when too high a brushing force is being applied.

SUMMARY OF THE INVENTION

The personal hygiene implement of the present invention can provide feedback to the user regarding too high of an applied brushing force. And, in some embodiments, the personal hygiene implement of the present invention can provide an indication to the user regarding too low of an applied brushing force, a sufficient amount of brushing force, a lower end of a range of the sufficient brushing force; and/or a high end of the range of the sufficient brushing force. In providing this feedback to a user, the personal hygiene implement of the present invention can assist the user in achieving better results when utilizing the personal hygiene implement.

In some embodiments, an oral hygiene implement may comprise a handle region, a head, and a neck extending between the handle region and the head. The head comprises a plurality of cleaning elements attached to the head. The handle region comprises a first portion and a second portion and a force sensor pivotally connected to the first portion and the second portion. The force sensor comprises the head and the neck, and the force sensor and the first portion and/or the second portion are integrally formed.

In some embodiments, an oral hygiene implement comprises a handle region, a head, and a neck extending between the handle region and the head. The head comprises a plurality of cleaning elements attached to the head, and the handle region forms a hollow cavity. A force sensor comprises the head and the neck and a distal portion disposed within the hollow cavity. The force sensor is pivotally connected to the handle region and is integrally formed with the handle region. An output source is in signal communication with the force sensor, such that when the force sensor is moved a predetermined distance, the output source provides a signal to a user.

DETAILED DESCRIPTION OF THE INVENTION

Definitions:

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

As used herein "personal hygiene implement" refers to any implement which can be utilized for the purposes of personal hygiene. Some suitable examples include toothbrushes, either manual or powered; razors, either manual or powered; shavers, either manual or powered; trimmers, etc.

As used herein, "oral hygiene implement" refers to any device which can be utilized for the purposes of oral hygiene. Some suitable examples of such devices include toothbrushes (both manual and power), flossers (both manual and power), water picks, and the like.

Description:

For ease of explanation, the oral hygiene implement described hereafter shall be a manual toothbrush; however, as stated above, an oral hygiene implement constructed in accordance with the present invention is not limited to a manual toothbrush construction. Additionally, the embodiments described hereafter are equally applicable to blades, razors, other personal hygiene implements, or the like.

Figure 1:
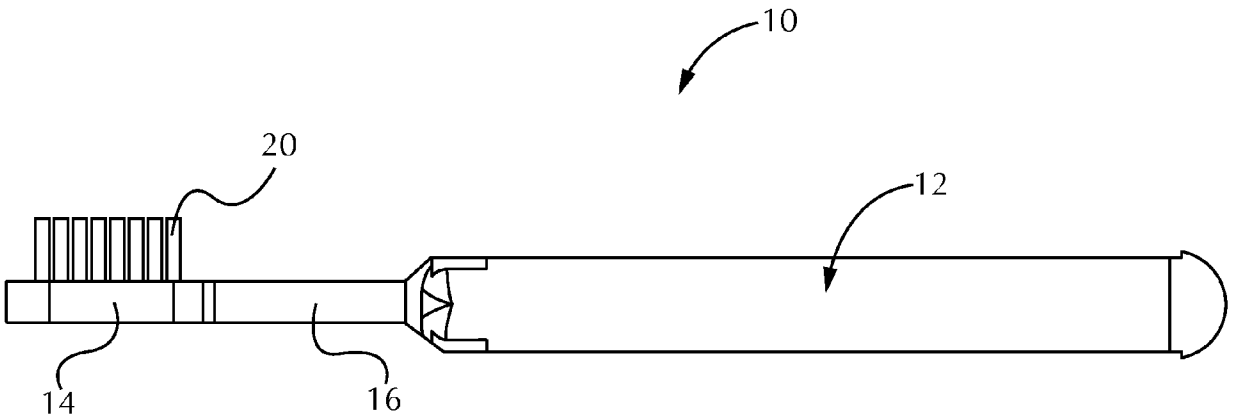
FIG. 1 is an elevational view showing a left side of an oral hygiene implement, e.g. a toothbrush, constructed in accordance with the present invention.
Figure 2:
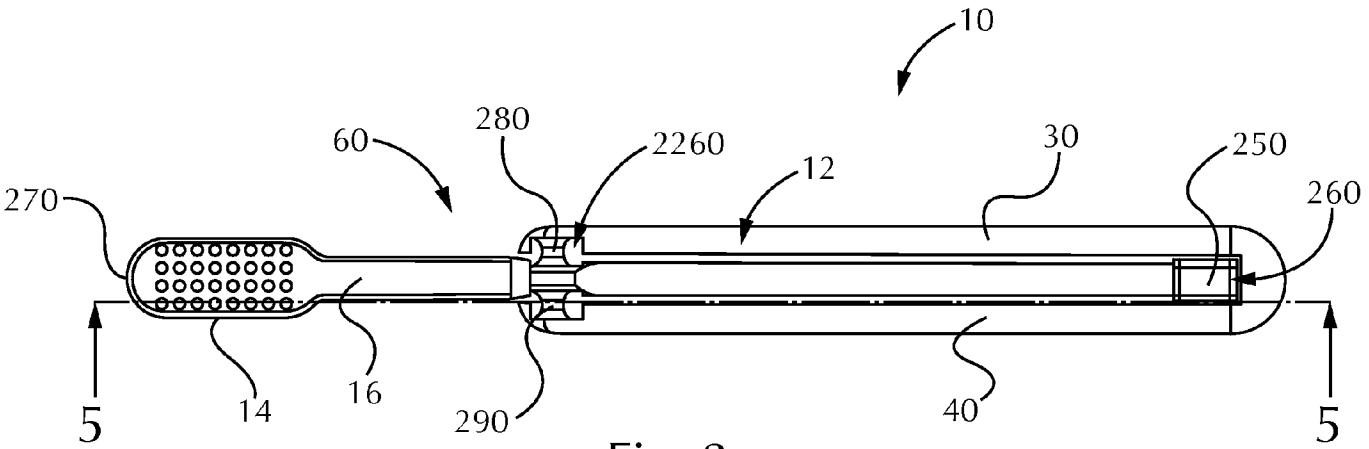
FIG. 2 is a plan view showing the front of the oral hygiene implement of FIG. 1.

As shown in FIGS. 1 and 2, in one embodiment, a toothbrush 10 comprises a handle region 12, a head 14, and a neck 16 extending between the handle and the head 14. A plurality of cleaning elements 20 are attached to the head 14. The handle region 12 may comprise a first portion 30 and a second portion 40. The first portion 30 and the second portion 40 may form part of the outer facing surface of the handle region 12.

A force sensor 60 may be pivotally mounted to the first portion 30 and/or the second portion 40. The force sensor 60 may comprise the head 14 and the neck 16. Additionally, the force sensor 60 may comprise an output source 250. As shown the output source 250 may be disposed adjacent a distal end 260 of the force sensor 60. The force sensor 60 further comprises a proximal end 270 which is opposite the distal end 260.

The force sensor 60 may be mounted via springs 280 and 290. The springs 280 and 290 may be integrally formed with the force sensor 60 and/or the first portion 30 and/or the second portion 40. In some embodiments, the springs 280 and 290 may be integrally formed with the force sensor 60 which is later attached to the first portion 30 and or the second portion 40. In some embodiments, the springs 280 and/or 290 may be integrally formed with the first portion 30 and/or the second portion 40, and the force sensor 60 can be later attached to the springs 280 and/or 290. In some embodiments, a portion 2260 of the force sensor 60 may be integrally formed with the first portion 30 and/or the second portion 40. For example, the portion 2260 may be integrally formed with the springs 280 and/or 290; the first portion 30 and/or the second portion 40 while the force sensor 60 comprises a replaceable head.

In the embodiments, where the force sensor 60 is integrally formed with the springs 280 and 290, the force sensor 60 and the springs 280 and 290 may be produced in a one step injection molding process, for example. Similarly, for those embodiments where the springs 280 and 290 are integrally formed with the first portion 30 and the second portion 40, the springs 280 and 290 and the first portion 30 and the second portion 40 may be produced in a one step injection molding process, for example. Additionally, for those embodiments where the force sensor 60, the springs 280 and 290, and the first portion 30 and the second portion 40 are integrally formed, they may be produced in a one step injection molding process, for example.

Figure 3A:
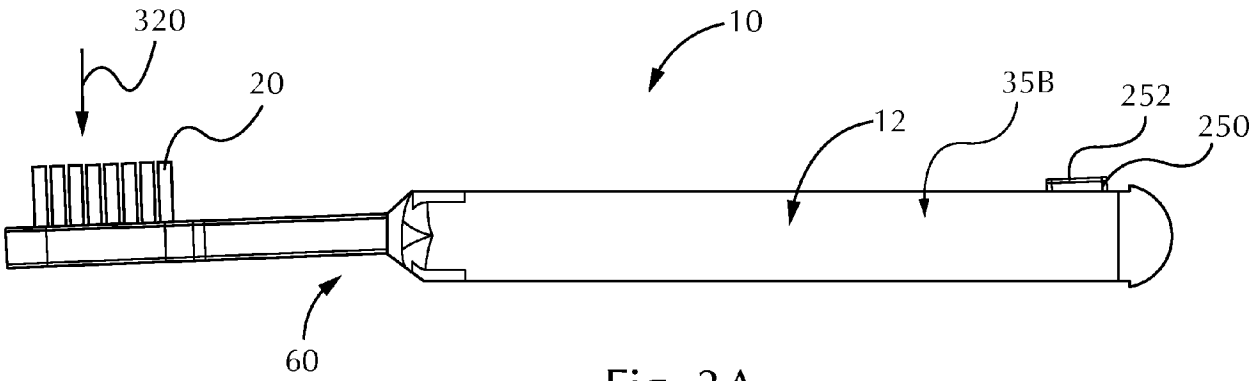
FIGS. 3A and 3B are side views showing the left side of the oral hygiene implement of FIG. 1, providing the user with a first indication and a second indication, respectively.
Figure 3B:
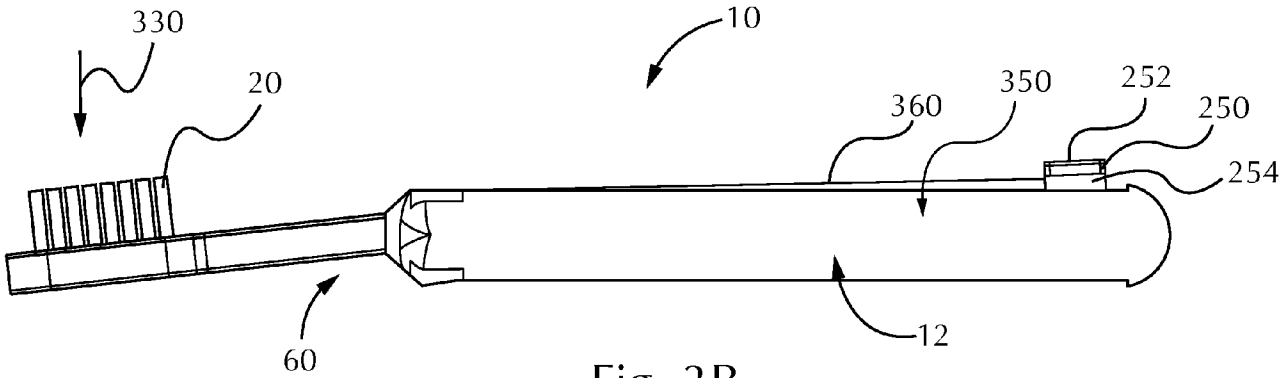

In operation, as shown in FIGS. 3A and 3B, when an adequate force 320 is applied to the cleaning elements 20, the force sensor 60 can pivot with respect to the handle region 12. At the distal end 260 (shown in FIG. 2) of the force sensor 60 the output source 250 provides a first visual cue 252 indicating the application of adequate force to the user. As shown in FIG. 3B, a higher application force 330 to the cleaning elements 20 can cause the force sensor 60 to pivot to a greater extent with regard to the handle region 12. The additional pivoting can cause the output source 250 to indicate a second visual cue 254. The second visual cue 254 may be different than the first visual cue 252. The second visual cue 254 may indicate to the user that the applied brushing force is too high.

In addition to the second visual cue 254, the force sensor 60 may similarly provide a tactile signal to the user. As shown in FIG. 3B, a portion 360 between the spring(s) 280 and 290 (shown in FIG. 2) and the distal end 260 (shown in FIG. 2) of the force sensor 60 may protrude from an outer facing surface 350 of the handle region 12 thereby providing tactile feedback to the user. In some embodiments, the portion 360 may be configured such that no tactile indication is provided to the user.

Figure 4A:
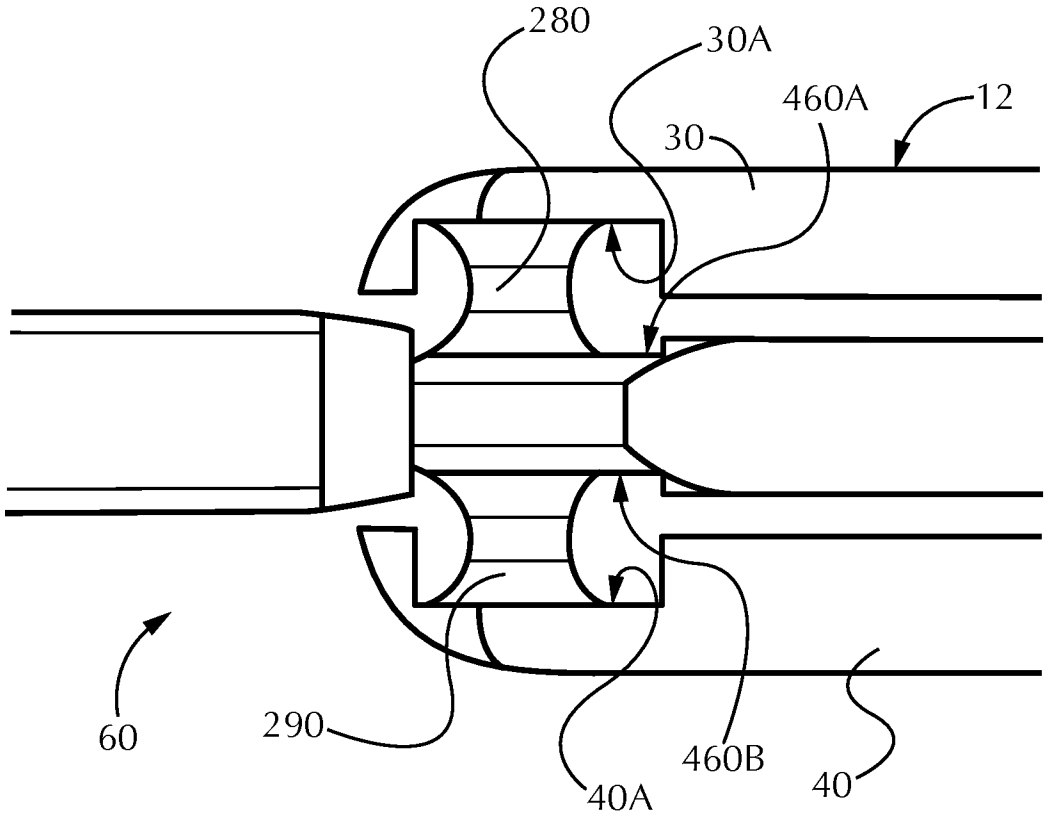
FIG. 4A is a close up view showing the connection between a force sensor and a first portion and second portion of the handle region of the oral hygiene implement of FIG. 1.

Referring to FIG. 4A, as stated previously, the force sensor 60 may be comprise springs 280 and 290. As shown, the springs 280 and 290 may comprise torsion bars. The force sensor 60 may pivot about the springs 280 and 290. The springs 280 and 290 should be constructed such that pivoting of the force sensor does not cause plastic deformation in the springs 280 and 290. Instead, the pivoting motion of the force sensor 60 should only cause elastic deformation of the springs 280 and 290.

The springs 280 and 290 should be designed to avoid fatigue failure. Variables which can impact fatigue failure and elastic deformation are material selection, sizing of the springs, and angular displacement of the springs 280 and 290.

The springs 280 and 290 may comprise any suitable size. For example, in some embodiments, the springs 280 and 290 may comprise a cross section area which is greater than about 3 $mm^2$ to about 50 $mm^2$, or any individual number within the range. In some embodiments, the springs may comprise a cross sectional area of between about 10 $mm^2$ to about 20 $mm^2$. Still in other embodiments, the springs may comprise a cross sectional area which is greater than about 3 $mm^2$, greater than about 5 $mm^2$, greater than about 7 $mm^2$, greater than about 10 $mm^2$, greater than about 15 $mm^2$, greater than about 17 $mm^2$, greater than about 20 $mm^2$, greater than about 25 $mm^2$, greater than about 30 $mm^2$, greater than about 35 $mm^2$, greater than about 40 $mm^2$, greater than about 45 $mm^2$, and/or less than about 50 $mm^2$, less than about 45 $mm^2$, less than about 40 $mm^2$, less than about 35 $mm^2$, less than about 30 $mm^2$, less than about 25 $mm^2$, less than about 20 $mm^2$, less than about 15 $mm^2$, less than about 12 $mm^2$, less than about 10 $mm^2$, less than about 7 $mm^2$, less than about 5 $mm^2$, or any ranges within the disclosed numbers. However, it is worth noting that if the cross sectional area of the springs 280 and 290 is too great, then the force sensor 60 will tend to bend as opposed to pivoting.

The springs 280 and 290 can be configured to influence the response force. One example of influencing the response force, is to change the cross sectional area of the springs 280 and/or 290. Other examples of influencing the response force include material selection, length of the spring. The length of the springs 280 and/or 290 are discussed in detail with regard to FIGS. 4B and 4C.

Figure 4B:
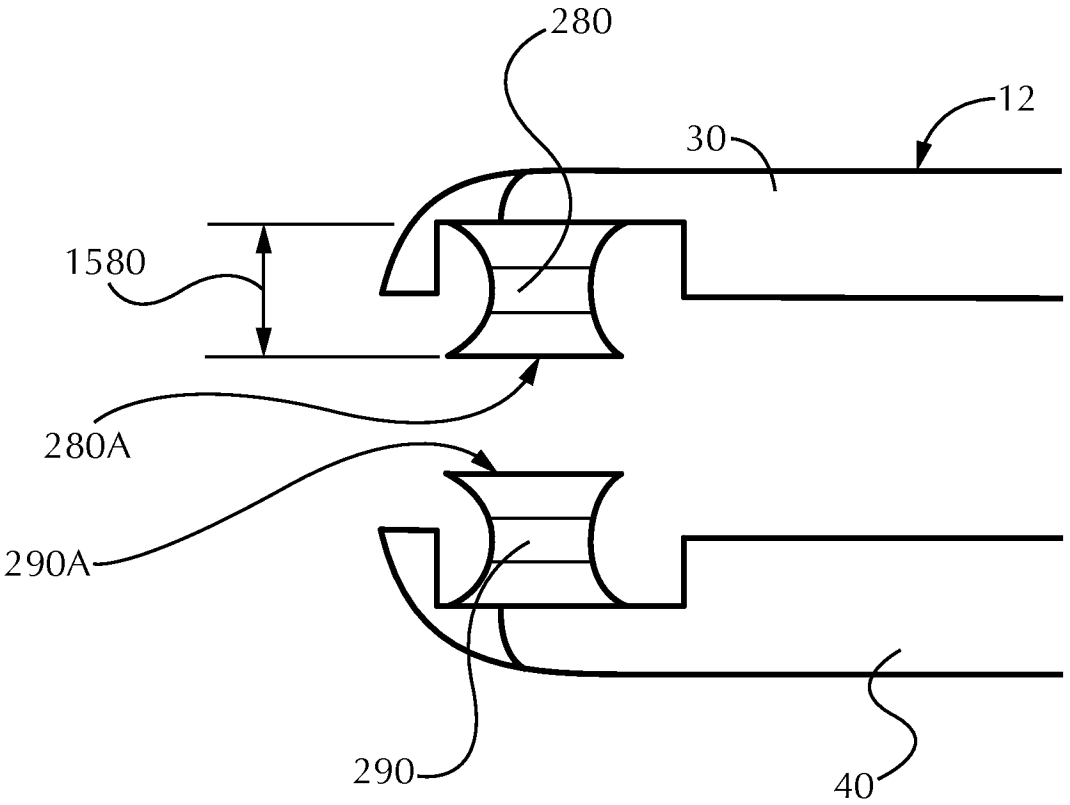
FIG. 4B is a close up view showing the handle region, in part, of the oral hygiene implement of FIG. 1, excluding the force sensor for ease of view.

Referring to FIGS. 4A and 4B, in some embodiments, the force sensor 60 may be later attached to the springs 280 and 290. In such embodiments, the spring 280 may be configured such that a first surface 460A of the force sensor 60 engages a first engaging surface 280A of the spring 280 such that the first surface 460A does not rotate with respect to the first engaging surface 280A. Similarly, the spring 290 may be configured such that a second surface 460B does not rotate with respect to a first engaging surface 290A of the spring 290.

As an example, the first engaging surface 280A may comprise a detent which engages with a complimentary depression in the first surface 460A. As another example, the first engaging surface 280A may comprise a complimentary depression which engages a detent which is comprised by the first surface 460A. As yet another example, both the first engaging surface 280A and the first engagement surface 460A may comprise a detent and a depression and be configured such that the detent of the first surface 460A engages the depression of the first engaging surface 280A and such that the detent of the first engaging surface 280A engages the depression of the first surface 460A. The second surface 460B and the first engagement surface 290A may be configured similarly. Embodiments are contemplated where a plurality of detents and complimentary depressions may be utilized on the first surface 460A, the second surface 460B, and/or the first engaging surfaces 280A and 290A.

Figure 4C:
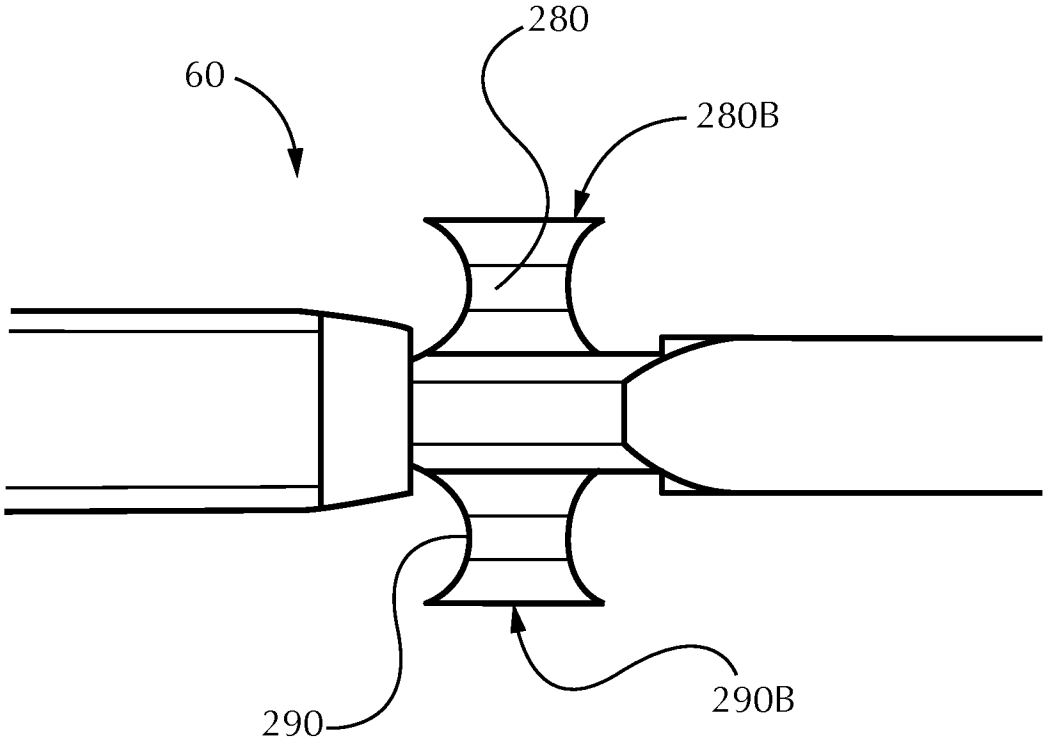
FIG. 4C is a close up view showing the force sensor, in part, of the oral hygiene implement of FIG. 1, excluding the handle region for ease of view.

Referring to FIGS. 4A and 4C, as stated previously, the force sensor 60 may be integrally formed with the springs 280 and/or 290. In such embodiments, the springs 280 and/or 290, may be configured such that a first inner-facing surface 30A of the first portion 30 engages a second engaging surface 280B of the spring 280 such that the first inner-facing surface 30A does not rotate with respect to the second engaging surface 280B. Similarly, the spring 290 may be configured such that a second inner-facing surface 40A does not rotate with respect to a second engaging surface 290B of the spring 290. The detents and depressions described heretofore may be utilized in order to preclude or at least reduce the likelihood of rotation. As mentioned heretofore, the length of the springs 280 and/or 290 can impact the response force provided by the springs 280 and/or 290. As shown in FIGS. 4B and 4C, a length 1580 of spring 280 is defined by the distance between the first engaging surface 280A and the second engaging surface 280B. The length 1580 of the spring 280 may be impacted by the material selected for the spring. Additional factors include aesthetics as well as gripability by a user. The length 1580 may be any suitable length. In some embodiments, the length 1580 may be greater than about 1 mm, greater than about 1.5 mm, greater than about 2.0 mm, greater than about 2.5 mm, greater than about 3.0 mm, greater than about 3.5 mm, greater than about 4.0 mm, greater than about 4.5 mm, greater than about 5.0 mm, greater than about 5.5 mm, greater than about 6 mm, greater than about 6.5 mm, greater than about 7 mm, greater than about 7.5 mm, and/or equal to about 8.0 mm, less than about 7.5 mm, less than about 7.0 mm, less than about 6.5 mm, less than about 6.0 mm, less than about 5.5 mm, less than about 5.0 mm, less than about 4.5 mm, less than about 4.0 mm, less than about 3.5 mm, less than about 3.0 mm, less than about 2.5 mm, less than about 2.0 mm, less than about 1.5 mm, or any individual numbers or ranges within the values given. Spring 290 may be constructed similarly.

Figure 5A:
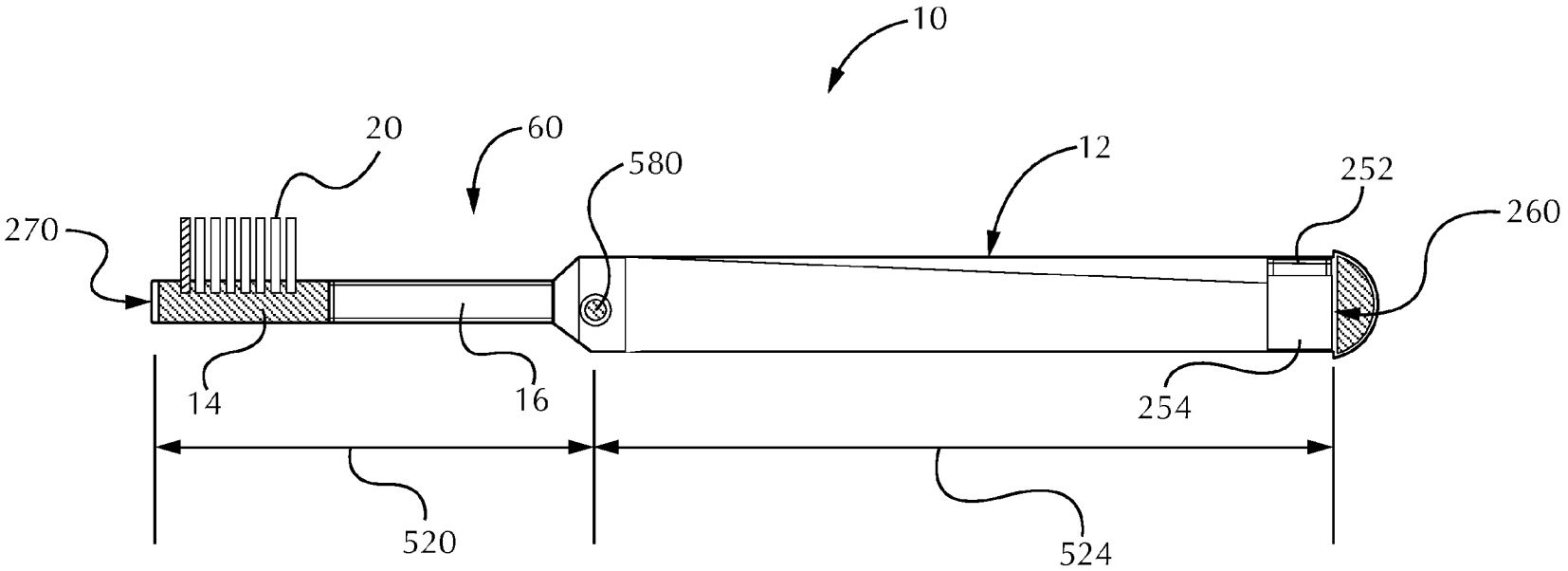
FIG. 5A is a cross sectional view showing the oral hygiene implement of FIG. 1 taken along line 5-5 shown in FIG. 2.

Referring to FIG. 5A, the output source 250 may comprise the first visual cue 252 and the second visual cue 254. The first visual cue 252 and the second visual cue 254 may be different from one another. For example, the first visual cue 252 may comprise a first color and the second visual cue 254 may comprise a second color. The first color may signify to the user that an adequate amount of brushing force is being applied, while the second color may indicate to the user that an excess amount of force is being applied. The toothbrush 10 of the present invention can be configured to provide the user with any suitable number of indications for one or more conditions. Such indications and conditions are discussed hereafter.

Figure 5B:
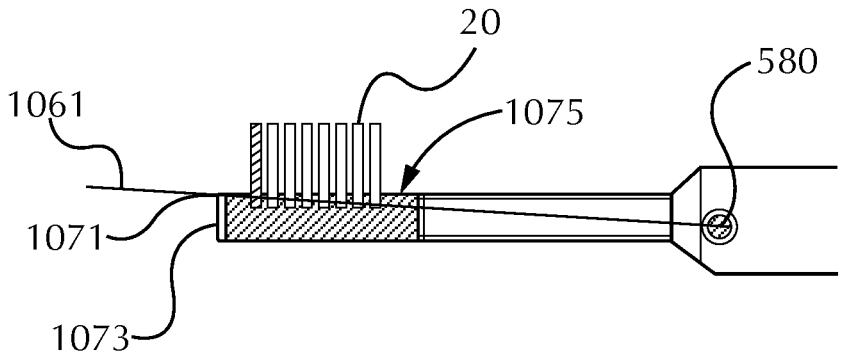
FIGS. 5B through 5D are close up views showing the head and neck of the oral hygiene implement shown in FIG. 5A.
Figure 5C:
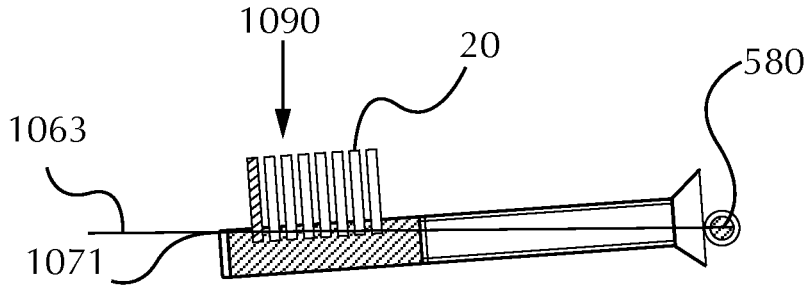
Figure 5D:
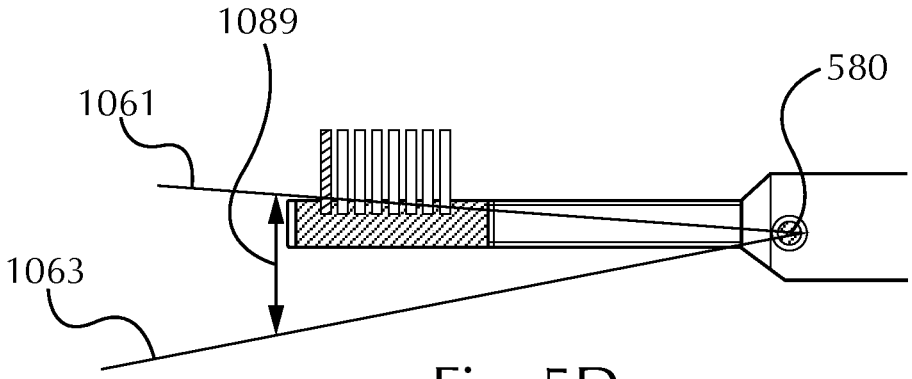

It has been discovered that with regard to toothbrushes, consumers tend to dislike a substantial amount of movement in the area of the toothbrush head. Specifically, consumers tend to dislike too much movement of the toothbrush head in a plane which is generally perpendicular to a pivot axis 580. Referring to FIGS. 5B, 5C, and 5D, the movement of the head in this plane can be determined by measuring a straight line distance 1089 between an at rest plane 1061 and an applied force plane 1063 where the straight line 1089 is orthogonal to the at rest plane 1061 and is tangent to the toothbrush head 14 at an intersection 1071.

The at rest plane 1061 extends through the pivot axis 580 and extends through the intersection 1071 between a side 1073 (which includes the proximal end 270) and a first face 1075 of the toothbrush head 14. Where the intersection 1071 includes a rounded edge, the point of intersection between the side 1073 and the first surface 1075 shall be the bisection of the rounded edge. The at rest plane 1061 is referenced while there is no load on the contact elements 20.

The applied force plane 1063, similar to the at rest plane 1061, extends through the pivot axis 580 and extends through the intersection 1071. The applied force plane 1063 is referenced while there is a predetermined applied load 1090 applied to the cleaning elements 20. The predetermined applied load 1090 is 5 Newtons.

In some embodiments, the straight line distance 1089 may be less than about 6 mm, less than about 5 mm, less than about 4 mm, less than about 3 mm, less than about 2 mm, less than about 1 mm and/or greater than about 1 mm, greater than about 2 mm, or any individual number within the ranges provided.

At least one advantage of utilizing torsion bars is that the springs 280 and 290 (shown in FIG. 2) can be well suited resist movement in non-desired directions. For example, movements of the toothbrush head in directions other than the movement in the plane perpendicular to the pivot axis 580 are non-desired. Such non-desired movement may cause the toothbrush to indicate false positives to a user. A false positive occurs when an indication is provided to the user that the brushing force is too high, when in reality the brushing force is not too high. Additionally, such non-desired movements may cause the toothbrush to incorrectly detect applied brushing forces. For example, such non-desired movement could cause a misalignment of internal systems thereby causing the toothbrush to provide no indication to the user even if a too high brushing force was being applied. Moreover, consumers tend to dislike such non-desired movements because such movements can cause a feeling of loss of control.

Also variances in manufacturing tolerances, specifically, non-integral constructions may make a pressure sensing toothbrush susceptible to non-desired movements and thereby increase the likelihood of incorrectly detecting applied brushing force. As such, brushes constructed in accordance with the inventions disclosed herein may be less susceptible to non-desired movements which may reduce the likelihood of incorrectly detecting applied brushing forces.

Referring back to FIG. 5A, in order to accomplish a reduced straight line distance 1089 (See FIG. 5D), variables such as a first distance 520 which is defined by the maximum straight line distance between the proximal end 270 and the pivot axis 580 of the force sensor 60 and a second distance 524 which is defined by the maximum straight line distance between the distal end 260 and the pivot axis 580 are important. In order to accommodate the desires of the consumer, the first distance 520 may be shorter than the second distance 524. For example, the first distance 520 may be less than about 90 percent of the second distance 524, less than about 80 percent, less than about 70 percent, less than about 60 percent, less than about 50 percent, less than about 40 percent, less than about 30 percent, less than about 20 percent, less than about 10 percent, and/or greater than about 10 percent, greater than about 20 percent, greater than about 30 percent, greater than about 40 percent, greater than about 50 percent, greater than about 60 percent, greater than about 70 percent, greater than about 80 percent, and/or any ranges or individual numbers disclosed within the percentages provided. When the first distance 520 and the second distance 524 are appropriately configured, a minimal amount of movement in the head can cause a much larger movement adjacent the distal end 260 of the force sensor 60.

Figure 6A:
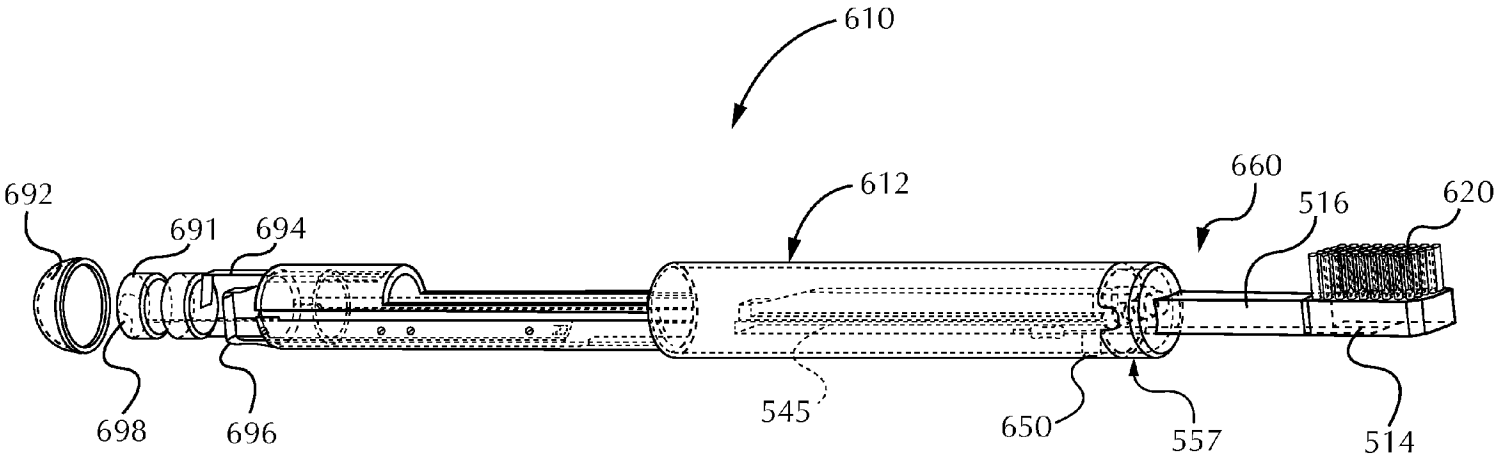
FIG. 6A is an exploded view including hidden lines showing another embodiment for an oral hygiene implement.
Figure 6B:
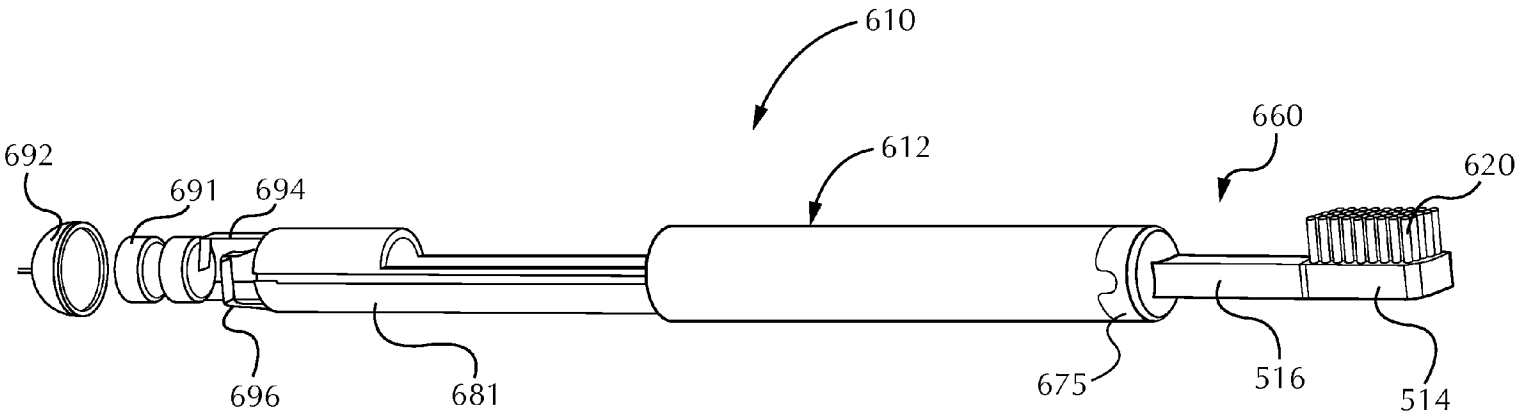
FIG. 6B is an exploded view showing the toothbrush of FIG. 6A

In some embodiments, a toothbrush constructed in accordance with the present invention may comprise an electrically powered element for providing an indication to the user. For example, a toothbrush in accordance with the present invention may comprise an LED which provides a signal to the user regarding a particular condition. As shown in FIGS. 6A and 6B, a toothbrush 610 may comprise an output source 650 which includes an LED. The toothbrush 610 may comprise a handle region 612 a head 514 and a neck 516 extending between the handle region 612 and the head 514. As shown, a force sensor 660 may comprise the head 514, the neck 516, and a distal portion 545 which is disposed within a hollow cavity of the handle region 612.

The hollow cavity of the handle region 612 may be appropriately sized such that a subcarriage 681 can be inserted into the hollow cavity. The subcarriage 681 may comprise a plurality of electrical contacts, e.g. 694, 696, and 698, and one or more power sources, 691, e.g. batteries. An end cap 692 may attach to the handle region 612 to enclose the subcarriage 681 within the hollow cavity. The end cap 692 may engage the subcarriage 681 such that one or more electrical contacts, e.g. 698, engage the power source 690 upon attachment of the end cap 692 to the handle region 612.

Additionally, as shown, a forward cap 675 may cover the hollow cavity of the handle region 612 adjacent to the neck 516. The forward cap 675 can reduce the likelihood of water and/or other contaminants entering the hollow cavity. For the toothbrushes 610 with electronic devices, the water and/or contaminants can cause electrical shorts which in turn can interrupt the functionality of the output source 650.

Any suitable material may be utilized for the forward cap 675. Some examples of suitable material include thermoplastic elastomers, silicone, nitrile butadiene rubber, ethylene propylene diene monomer rubber, or the like. Additionally, the forward cap 675 may be fixed to the handle region 612 in any suitable manner, for example, overmolding. In some embodiments, the handle region 612 and the forward cap 675 may overlap to some extent to help reduce the likelihood of contaminants entering between the seam of the forward cap 675 and the handle region 612. In some embodiments, the material of the forward cap 675 may also extend along a portion or portions of the handle region 612, to provide a gripping surface.

Figure 7:
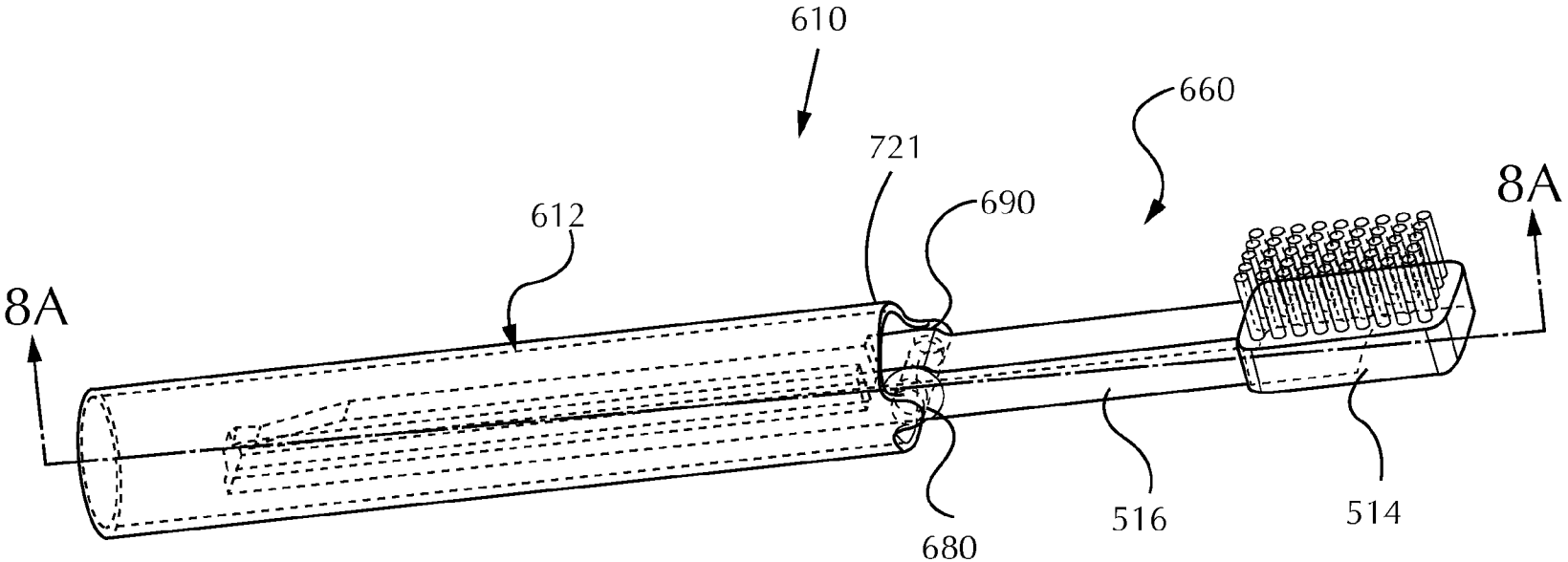
FIG. 7 is a perspective view showing the oral hygiene implement of FIG. 6A.

As shown in FIG. 7, the force sensor 660 may be attached to the handle region 612 via springs 680 and 690. In some embodiments, the force sensor 660 may be integrally formed with the springs 680 and 690. In such embodiments, the springs 680 and 690 may then be attached to a wall portion 721 of the handle region 612. In some embodiments, the force sensor 660, the springs 680 and/or 690, and the handle region 612 are all integrally formed. In some embodiments, the springs 680 and/or 690 may be integrally formed with the handle region 612 and subsequently the force sensor 660 may be attached to the springs 680 and/or 690. Where helpful, the springs 680, 690, the force sensor 660, and/or the wall portion 721, may be provided with detents and complimentary recesses as described heretofore. The springs 680 and/or 690 may be configured as described herein with regard to springs 280 and 290. For example, the springs 680 and/or 690 may comprise torsion bars.

Figure 8A:
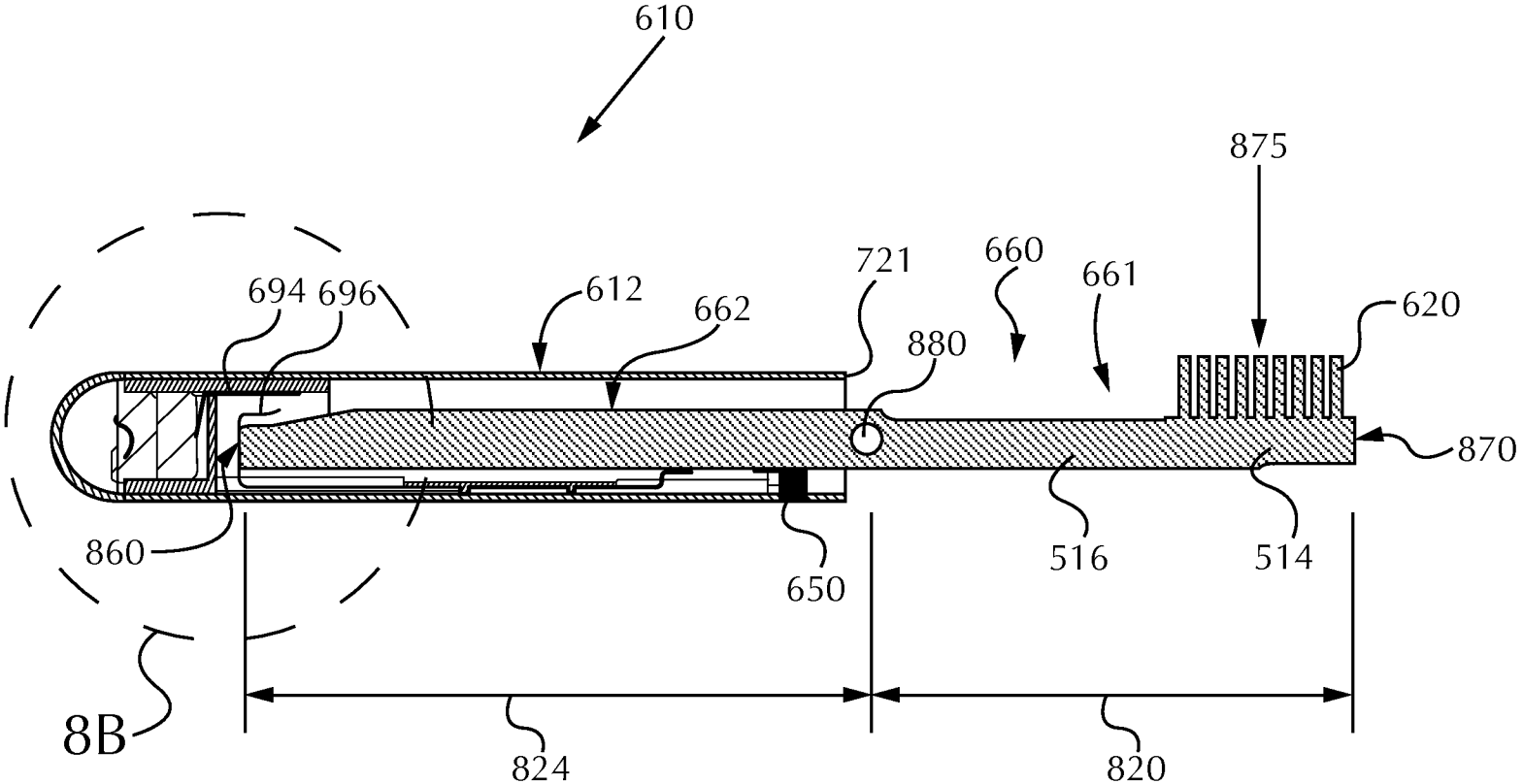
FIG. 8A is a cross sectional view showing the oral hygiene implement of FIG. 6 taken along line 8A-8A shown in FIG. 7.

Referring to FIG. 8A, the force sensor 660 may be configured similar to the force sensor 60 (shown in FIG. 5). Namely, a first portion 661 of the force sensor 660 comprising the head 514, may comprise a first distance 820 which is defined by the maximum straight line distance between a proximal end 870 and a pivot axis 880 of the force sensor 660, and a second portion 662 of the force sensor 660 may comprise a second distance 824 which is defined by the maximum straight line distance between the pivot axis 880 and a distal end 860 of the force sensor 660. The first distance 820 may be shorter than the second distance 824 by the same percentages discussed herein with regard to the first distance 520 and the second distance 524.

In operation, a force 875 is applied to cleaning elements 620 on the head 514 of the toothbrush 610. If the force 875 is an adequate level which does not exceed a predetermined value, the distal end 860 of the force sensor 660 does not move to such an extent as to close the contacts 694 and 696. However, if the force 875 is deemed to be too high, then the force sensor 660 can pivot about the pivot axis 880 to such an extent as to close the contacts 694 and 696 thereby completing the circuit. Once the circuit is completed, energy may be sent to the output source 650 thereby energizing the output source 650.

The contact 696 along with the springs 680 and/or 690 may provide the appropriate resistance such that an adequate brushing force 875 does not cause the contacts 694 and 696 to close. However, embodiments are contemplated where the contact 696 is designed to provide all of the resistance of the force sensor 660 such that an adequately applied brushing force 875 does not cause the contact 696 and 694 to close thereby energizing the circuit. In these embodiments, the springs 680 and 690 may not provide resistance to the motion of the force sensor 660 with respect to the handle region 612. And, in these embodiments, the force sensor 660 may be produced separately from the handle region 612 and subsequently attached to the handle region 612.

Several variables of the contact 696 may impact the resistance that the contact 696 provides to the movement of the force sensor 660. For example material selection, cross sectional area, width, thickness, free length, the like, or combinations thereof, may impact the force resistance provided by the contact 696. Without wishing to be bound by theory, it is believed that the contact 696 can provide more fine tuning of the force response of the force sensor than the configuration of the springs discussed heretofore.

Figure 8B:
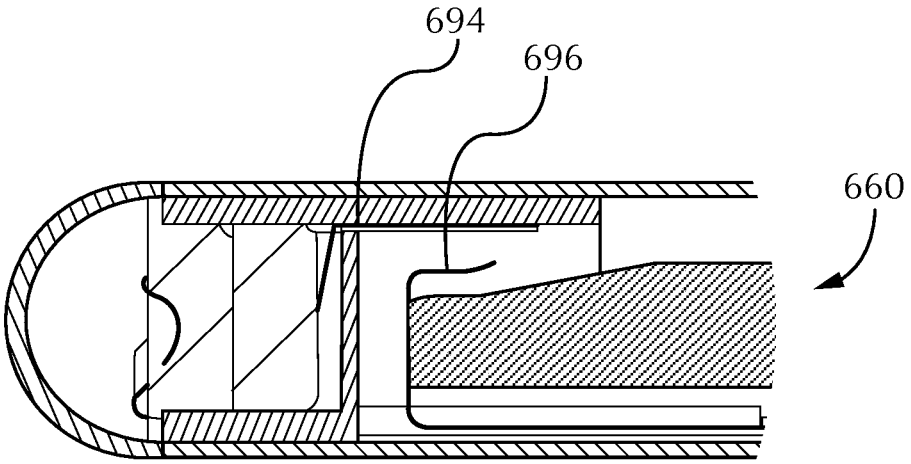
FIG. 8B is a close up view showing a portion of the oral hygiene implement of FIG. 6A.

As shown in FIG. 8B, the contact 696 can be a separate part which comprises a conductive material. Any suitable conductive material may be utilized. For example, steel, copper, aluminum, brass, tin, etc, the like or combinations thereof may be utilized for one or more of the contacts 694, 696, and/or 698. However, embodiments are contemplated where one or more of the electric contacts is formed of an electrically conductive non-metallic material.

The term "electrically conductive non-metallic materials" as used herein includes materials comprising one or more non-metals and one or more metals, such as polymeric compositions containing metal particles. Often such compounds are made by mixing solid conductive particles such as carbon black, stainless steel fibers, silver or aluminum flakes or nickel-coated fibers with electrically insulating bulk thermoplastics, for example polystyrene, polyolefins, nylons, polycarbonate, acrylonitrile-butadiene-styrene co-polymers (ABS), and the like.

Recently, there has been an increased interest in replacing carbon black or metal particle-filled compounds of the above-described type with intrinsically electrically conductive polymers and their blends with common insulating polymers including, but not limited to polyanilines. Polyaniline (or abbreviated PANI) and its synthesis and the preparation of the electrically conductive form of this polymer by, for example, contacting polyanilines with protonic acids resulting in salt complexes has been described in the prior art. Additionally, electrically conductive polymers are known and used in industrial settings, particularly in the manufacture of electronic component parts. Some examples of electrically conductive polymer compositions are illustrated in U.S. Pat. Nos. 5,256,335; 5,281,363; 5,378,403; 5,662,833; 5,958,303; 6,030,550; and 6,149,840. Additional electrically conductive polymer compositions are described in U.S. Pat. Nos. 5,866,043 and 6,685,854. The term "electrically conductive non-metallic materials" as used herein also includes these types of compositions.

Another electrically conductive substrate suitable for use in the present invention is discussed in U.S. Pat. Nos. 6,291,568, 6,495,069, and 6,646,540. This substrate has a first level of conductance when quiescent, or inactive, and a second level of conductance resulting from a change of stress; i.e. mechanical or electrical stress. The mechanical stress can include stretching and/or compressing. This substrate comprises a granular composition, each granule of which comprises at least one substantially non-conductive polymer and at least one electrically conductive filler. The conductive filler can be one or more metals, other conductive or semi-conductive elements and oxides or intrinsically conductive semi-conductive inorganic or organic polymers. The granules are typically up to 1 mm, and the granule (conductor) to polymer volumetric ratio is suitably at least 3:1. It is contemplated that other substrates which conduct electricity when compressed are suitable for use in the present invention.

In such embodiments where the contact 696 comprises an electrically conductive non-metallic material, the contact 696 may be integrally formed with the subcarriage 681. However, in such embodiments, care should be taken to ensure that the remaining contacts 694 and 692 are insulated from any conductive portions of the subcarriage 681 to reduce the likelihood of electrical shorts.

Figure 9:
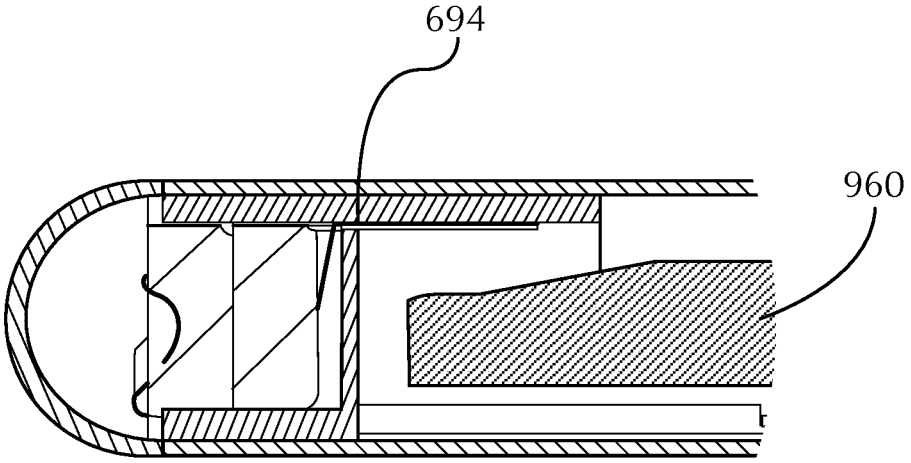
FIG. 9 is a close up view showing a portion of another embodiment for the oral hygiene implement of FIG. 6A.

As shown in FIG. 9, the force sensor 960 may comprise an electrically conductive non-metallic material. In such embodiments, the contact 696 (shown in FIGS. 7, 8A, and 8B) may not be required. For example, during non-use the force sensor 960 may be non-conductive; however, during use, if a predetermined mechanical stress or higher is applied, the force sensor 960 may become conductive. As another example, during adequate force during brushing, the force sensor 960 may be non-conductive, but during applications of high applied brushing force, the force sensor 960 may become conductive.

Referring back to FIGS. 6A, 6B, 7, 8A, and 8B, the output source 650 may be in electrical communication with the force sensor 660 and provide an output signal to a user when the user applies too much force. However, embodiments are contemplated where the toothbrush 610 provides an output signal to the user corresponding to the application of (1) too little force, and/or (2) a sufficient force during their oral hygiene routine. Any suitable output signal may be provided to the user. Some suitable examples of output signals include vibration (tactile), audible, visual, the like, or combinations thereof. For example, where the output signal is vibration, the output source 650 may comprise a motor which rotates an eccentric weight. As another example, where the output signal is audible, the output source 650 may comprise a horn, piezo audio indicator, magnetic audio indicator, audio transducer, speaker, buzzer, and/or like.

With regard to visual cues provided to the user, any suitable number may be provided. For example, a plurality of visual cues may be provided to the user. Visual cues or other signal/indications to the user can be provided for a number of different conditions. For example, the output source 650 may be configured such that the user is only provided a single signal which corresponds to one of the following conditions: (1) too little force is being applied; (2) too much force is being applied; or (3) a sufficient force is being applied. As yet another example, the output source 650 may be configured such that the user is provided with two signals which are selected from the following conditions: (1) too little force is being applied; (2) too much force is being applied; and/or (3) a sufficient force is being applied. As yet another example, the output source 650 may be configured such that the user is provided with two signals which may include signaling the following conditions (1) too much force is being applied, within a range just above sufficient force; and (2) a much higher force is being applied (much higher than suitable force). As yet another example, the output source 650 may be configured to provide to the user more than two signals. In such embodiments, the output source 650 may be configured to provide to the user a signal for each of the following conditions: (1) too little force is being applied; (2) too much force is being applied; and/or (3) a sufficient force is being applied. As yet another example, the output source 650 may be configured such that the user is provided with more than two signals may include signaling for the following conditions (1) too much force is being applied, within a range just above sufficient force; and (2) a much higher force is being applied (much higher than suitable force) and/or (3) a sufficient force is being applied. Other contemplated conditions for which signals can be provided to the user include limits for the sufficient force. For example, high and low ends of a range of the sufficient force can be signaled to the user. In such examples, a lower end of the range of the sufficient force and/or an upper end of the range of the sufficient force can be signaled to the user. In this regard, a sufficient force range can be developed to allow some flexibility to the user.

As stated above, combinations of signals can be utilized for any combination of conditions. For example, to signal the user that too little force is being applied, a first signal may be audible while a second signal signifying too much force may be visual. Any suitable combinations of signals can be utilized. As yet another example, to signal the user that too little force is being applied, a first signal may be visual and comprise a first color while a second signal signifying too much force may be a second color which contrasts with the first color. Any suitable colors may be utilized, e.g. red, green, yellow, blue, purple, the like, or combinations thereof. Such combinations of signals may also be applied where the output source 650 is configured to provide a signal for a sufficient force and/or upper and lower values thereof.

Several considerations can be taken into account when trying to evaluate the above conditions. For example, mouth feel, cleaning efficacy, etc. With regard to mouth feel, for example, oral care implements comprising cleaning elements which are very soft can generally provide a comfortable mouth feel to a user at forces which are higher than those oral care implements having more stiff cleaning elements. As another example, cleaning elements which comprise elastomeric materials may be more comfortable for a user and therefore may allow a higher force to be applied during brushing while still being within the user's comfort level. With regard to efficacy, cleaning elements having surface features, as described in U.S. Pat. Nos. 5,722,106; 5,836,769; 6,058,541; 6,018,840; U.S. Patent Application Publication Nos. 2006/0080794; 2006/0272112; and 2007/0251040, may require a lower force during brushing to provide sufficient cleaning/plaque removal when compared to cleaning elements having smooth surface features.

Another consideration which can be taken into account includes clinical safety. For example, a force which provides good mouth feel to consumer may cause gum irritation, gum recession, and/or tooth enamel abrasion.

Several variables can affect the considerations above, e.g. mouth feel, cleaning efficacy, clinical safety. For example, users may apply a specific brushing force while utilizing a powered toothbrush and a different force while utilizing a manual toothbrush. As another example, length of the cleaning elements, cross sectional shape of the cleaning elements, e.g. diameter, bending properties, etc. Because of the numerous variables which can impact the above considerations, consumer testing, clinical testing, and/or robot testing may be utilized to empirically determine values for: (1) too little force being applied; (2) too much force being applied; and/or (3) sufficient force being applied; (4) a low end of the sufficient force range being applied; and/or (5) a high end of the sufficient force range being applied, which can still provide comfortable mouth feel, cleaning efficacy, and clinical safety.

Consumer testing and/or clinical testing may provide some insight as to an appropriate value for the upper end of the tolerance of a sufficient force for a particular brush and/or an appropriate value for the lower end of the tolerance of the sufficient force for the particular brush. In general, consumers would try a particular toothbrush and can apply a prescribed force while brushing. After brushing, the consumers may be asked to provide feedback with regard to the feel of the brush in the oral cavity. Additionally, plaque scans can be taken of the oral cavities of consumers prior to brushing and then post brushing. Comparison can be made of the before and after in order to determine efficacy at a particular force. Moreover, clinical testing can be performed on the upper end of the range of the sufficient force to determine whether gum irritation, gum recession, and/or tooth enamel abrasion occurs at this value.

Similarly, robot testing may be utilized to determine efficacy of a particular brush at a given force. In robot testing, generally, a toothbrush is operated by a robot arm which moves the toothbrush in a brushing motion across teeth of a model of an oral cavity. Generally, the teeth of the model are covered by a synthetic plaque which is well known in the art. The robot arm can apply a predetermined force to the toothbrush during the simulation. After the simulation, plaque analysis of the before brushing and after brushing can be compared. From the before and after plaque analysis, a cleaning/efficacy determination can be made. Through iteration, the lower level of sufficient force range may be determined for any cleaning element/massaging element configuration.

Each of consumer testing, clinical testing, and robot testing can provide useful information on the values of force associated with the conditions: (1) too little force being applied; (2) too much force being applied; and/or (3) a sufficient force being applied; (4) a lower end of the sufficient force range being applied; and/or (5) an upper end of the sufficient force range being applied, which can still provide comfortable mouth feel as well as cleaning efficacy.

In some embodiments, a value of too much applied brushing force may be greater than or equal to about 1 Newton, 1.25 Newtons, 1.5 Newtons, 1.75 Newtons, 2.00 Newtons, 2.10 Newtons, 2.20 Newtons, 2.30 Newtons, 2.40 Newtons, 2.50 Newtons, 2.60 Newtons, 2.75 Newtons, 2.85 Newtons, greater than or equal to about 3.00 Newtons, greater than or equal to about 3.50 Newtons, greater than or equal to about 3.75 Newtons, greater than or equal to about 4.00 Newtons, greater than or equal to about 4.25 Newtons, greater than or equal to about 4.50 Newtons, greater than or equal to about 4.75 Newtons, greater than or equal to about 5.00 Newtons, greater than or equal to about 5.25 Newtons, greater than or equal to about 5.50 Newtons, greater than or equal to about 5.75 Newtons, or greater than or equal to about 6.00 Newtons. In some embodiments, a value of too little force being applied may be less than or equal to about 5.00 Newtons, about 4.75 Newtons, about 4.5 Newtons, about 4.25 Newtons, about 4.00 Newtons, about 3.75 Newtons, about 3.5 Newtons, about 3.25 Newtons, about 3.00 Newtons, about 2.75 Newtons, about 2.50 Newtons, about 2.25 Newtons, about 2.00 Newtons, about 1.75 Newtons, about 1.50 Newtons, about 1.25 Newtons, about 1.00 Newtons, about 0.75 Newtons, or about 0.50 Newtons. In some embodiments, values for a low end of a sufficient force range, an upper end of the sufficient force range, and/or the sufficient force range may be selected from any of the values provided above with regard to the too much force and/or too little force conditions.

The signal provided to the user may be constant, e.g. provide a signal to the user during the entire brushing routine. Alternatively, the signal provided to the user can be provided at the end of the brushing routine. For example, where the user applied too high of a force during the majority of brushing routine, the signal provided to the user may flash red or show a red visible signal for a predetermined time period. As another example, where the user applied too low of a force during the majority of the brushing routine, the signal provided to the user may flash yellow or show a yellow visible signal for a predetermined period of time. As yet another example, where the user applied a sufficient force during the majority of the brushing routine, the signal provided to the user may flash green or show a green visible signal for a predetermined period of time.

In other embodiments, the signal can be provided to the user intermittently during the brushing routine. For example, the signal can be provided to the user on predetermined time intervals. For example, a signal may be provided to the user every 20 seconds. Any suitable time interval can be selected. For example, the time interval between signals can be greater than about 0.1 second, greater than about 0.2 seconds, greater than about 0.3 seconds, greater than about 0.4 seconds, greater than about 0.5 seconds, greater than about 0.6 seconds, greater than about 0.7 seconds, greater than about 0.8 seconds, greater than about 0.9 seconds, greater than about 1 second, greater than about 2 seconds, greater than about 3 seconds, greater than about 4 seconds, greater than about 5 seconds, greater than about 6 seconds, greater than about 10 seconds, greater than about 15 seconds, greater than about 20 seconds, greater than about 25 seconds, greater than about 30 seconds, greater than about 40 seconds, greater than about 50 seconds, greater than about 60 seconds, and/or less than about 60 seconds, less than about 50 seconds, less than about 40 seconds, less than about 30 seconds, less than about 25 seconds, less than about 20 seconds, less than about 15 seconds, less than about 10 seconds, less than about 5 seconds, less than about 4 seconds, less than about 3 seconds, less than about 2 seconds, less than about 1.5 seconds, less than about 1, less than about 0.9 seconds, less than about 0.8 seconds, less than about 0.7 seconds, less than about 0.6 seconds, less than about 0.5 seconds, less than about 0.4 seconds, less than about 0.2 seconds, or less than about 0.1 seconds.

Referring still to FIGS. 6A and 6B, the toothbrush 610 of the present invention may further comprise a processor. The processor may be in signal communication with the force sensor 660 and the output source 650. The processor may be utilized to log the performance of the user for the duration of the brushing regimen. For example, the user may brush for a predetermined time period, e.g. two minutes, after such time period the processor may cause the output source 650 to provide the user with a signal that a sufficient force was applied for the duration of the two minute period. As another example, the processor may cause the output source 650 to provide the user with a signal that a sufficient force was applied for about half of the two minute period. As yet another example, the processor may cause the output source 650 to provide the user with a signal that a high force was applied for all and/or more than fifty percent of the two minute period. As yet another example, the processor may cause the output source 650 to provide the user with a signal that a low force was applied for all and/or more than fifty percent of the two minute period. The signals provided to the user may include those signals previously described herein.

Additionally, the processor may be useful in eliminating force spikes from indication. In such embodiments, the processor may serve as a buffer for the output source 650 by building in a time delay between occurrence of the condition and the provided signal by the output source 650. For example, the processor may be configured to include a five second time delay such that an applied brushing force which is too high must remain too high for at least five seconds before the processor causes the output source 650 to provide a signal to the user. Configured as such, the processor may filter the input from the force sensor 660 such that the output source 650 does not cause a plurality of flashing signals to the user. The time delay may be any suitable delay. For example, in some embodiments, the time delay may be less than about 10 seconds, less than about 9 second, less than about 8 second, less than about 7 second, less than about 6 second, less than about 5 seconds, less than about 4 seconds, less than about 3 seconds, less than about 2 seconds, less than about 1 second, less than about 0.75 seconds, less than about 0.5 seconds, less than about 0.25 seconds, less than about 0.10 seconds.

Other suitable mechanisms to reduce and/or eliminate force spikes may be utilized. For example, in some embodiments a low pass filter of at least the first order may be utilized. In such embodiments, the low pass filter may preclude a force spike from being transmitted to the output source 650 because of the high frequency of the force spike. As another example, the processor may be programmed to include a digital filter which can eliminate force spikes from causing signal output. Force spike filtration is further described in U.S. Pat. No. 7,120,960.

Previously, a time interval between signals was discussed. In some embodiments, the processor may be configured to modify the time interval between the signals provided to the user either during a particular brushing routine or over a series of brushing routines. For example, during a first brushing routine, if the user alternates between too much force and/or too little force, the interval between signals to the user may be at a first time interval. However, if in the first brushing routine, the user also provides a force which is predetermined to be within the sufficient force range, the signals to the user may be at a second time interval. In such an embodiment, the first time interval may be less than the second time interval thereby providing more feedback to the user. In some embodiments, the time intervals may be switched such that the user if provided more feedback for forces which are within the predetermined sufficient force range.

As stated previously, the processor may similarly modify the time interval between signals provided to the user over a series of brushing routines. For example, during a first brushing routine, the user may apply too much force and/or too little force for a majority of a time period of the first brushing routine. During the first brushing routine, the time interval between signals may be at a first time interval. The processor may be configured to process data regarding applied force during the first brushing routine and modify the time interval for the next brushing routine. For example, for a second brushing routine, based upon the data of the first brushing routine, the processor may modify the time interval between signals during the second brushing routine to a second time interval. The second time interval may be less than the first time interval such that the user may be provided more feedback during the second brushing routine. If during the second brushing routine, the user, for a majority of the time period of the second brushing routine, applies a force within a range of sufficient force, then the processor may modify the time interval between signals for a third brushing routine. For example, the time interval between signals for the third brushing routine may be less than the second time interval. However, if during the second time interval, the user applies, for a majority of the second brushing routine a force which is too high and/or too low for a majority of the time period of the second brushing routine, then the processor may adjust the time interval between signals for the third brushing routine to be less than the second time interval such that the user may be provided with even more feedback than in the second brushing routine. In some embodiments, the processor may be configured to provide more feedback with regard to a force within the range of sufficient force at increasing and/or decreasing time intervals.

The output source 650 may comprise a plurality of visual components, e.g. LEDs. For example, as stated above, the visual output signal may comprise a series of light sources which form a bar graph. The use of at least one light source and/or a plurality of light sources to provide feedback to the user is discussed in more detail in U.S. Pat. No. 7,120,960 and PCT application serial number IB2010/051194, entitled "Electric Toothbrush and Method of Manufacturing an Electric Toothbrush", filed on Mar. 18, 2010.

For output signals which comprise a visible signal, placement of a light source, e.g. may be in any suitable location. Referring to FIG. 6A, some examples of suitable locations include on the handle region 612; between the neck 616 and the handle region 612. While the light source may be placed on the handle region 612, there is a tendency for the light source to be blocked from the view of the user by the user's hand. To facilitate viewing by the user, an area 557 overlapping the neck 616 and the handle 612 can be particularly beneficial for the location of the light source. The area 557 may be disposed on a backside surface of the toothbrush 610.

Additionally, the light source can be selected such that the light source has a wide dispersion angle. The light source can be positioned on the toothbrush such that the light emitted from the light source is in the line of sight of the user. In some embodiments, the light source can be positioned such that the light emitted from the light source shines on the face of the user. For example, the light from the light source can light up the user's face when activated. This shining of the light on the user's face can facilitate the viewing by the user even in the absence of a mirror. In such embodiments, the light source can be positioned asymmetrically with respect to a longitudinal axis of the toothbrush 10. In such embodiments, the light source may be positioned at an angle towards the face of the user.

The output source 650 may be provided on the toothbrush 610 in any suitable location, e.g. handle 612, neck 616, and/or head 614. For example, the output source 650 may be disposed within the toothbrush 10; on the surface of the toothbrush 10; or partly within and partly exterior to the toothbrush 10.

In some embodiments, the output source 650 may comprise an external display which is in signal communication with the toothbrush 610. In such embodiments, the external display and the toothbrush 610 may communicate with one another via any suitable manner. Some suitable examples of communication between a personal hygiene device, e.g. toothbrush, and an external display are described in U.S. Patent Application Ser. Nos. 61/176,618, entitled, "PERSONAL CASER SYSTEMS, PRODUCTS, AND METHODS", filed on May 8, 2009; 61/180,617, entitled, "PERSONAL CASER SYSTEMS, PRODUCTS, AND METHODS", filed on May 22, 2009; and U.S. Patent Application Publication No. 2008/0109973. In such embodiments, the signal discussed herein may be provided to the user via the external display.

The force sensors 60, 660, and 960 may be formed of a variety of suitable materials. The materials suitable for the force sensor 960 are discussed heretofore. With regard to the force sensors 60 and 660, the materials for these force sensors should be selected such that the force sensor 60 and 660 can withstand forces, e.g. no permanent deformation, minimal deflection if any, applied during brushing. Additionally, suitable materials may be non-corrosive and stiff. Some suitable examples of materials which may be utilized for the force sensor 60 and 660 include stainless steel, plated steel, high density plastics, the like, and/or combinations thereof. Other examples of suitable materials include polypropylene, acrylonitrile butadiene styrene, polyoxymethylene, polyamide, acrylonitrile styrene acrylate, and polyethyleneterephthalate (PET).

In some embodiments, recycled and/or plant derived plastics may be utilized. For example, PET may be utilized in some embodiments. The PET may be bio based. For example, the PET may comprise from about 25 to about 75 weight percent of a terephthalate component and from about 20 to about 50 weight percent of a diol component, wherein at least about one weight percent of at least one of the terephthalate and/or the diol component is derived from at least one bio-based material. Similarly, the terephthalate component may be derived from a bio based material. Some examples of suitable bio based materials include but are not limited to corn, sugarcane, beet, potato, starch, citrus fruit, woody plant, cellulosic lignin, plant oil, natural fiber, oily wood feedstock, and a combination thereof.

Some of the specific components of the PET may be bio based. For example, monoethylene glycol and terephthalic acid may be formed from bio based materials. The formation of bio based PET and its manufacture are described in United States Patent Application Publication Nos. 20090246430A1 and 20100028512A1.

In some embodiments, the toothbrush may include a replaceable head, e.g. 14, 614 and/or neck 16, 616. Specifically, the head 14, 614 may be removable from the neck 16, 616 and/or the neck 16, 616 may be removable from the handle region 12, 612. Hereafter, whether the head 14, 614 is removable from the neck 16, 616 or the neck 16, 616 is removable from the handle region 12, 612, such replaceable elements will be termed "refills". In such embodiments, the processor may be programmed with a plurality of algorithms in order to establish the predetermined values for a force which is (1) too high; (2) too low; (3) sufficient; (4) at a low end of a range of sufficient force and/or (5) at a high end of a range of sufficient force for a number of different refills. For example, if the high end of a range of sufficient force for a first refill is 3.00 Newtons and the high end of a range of sufficient brushing force for a second refill is 3.50 Newtons, the processor may be configured to recognize the high end range value for first refill and the high end range value for the second refill. As such, the processor may be programmed such that the output source 650 provides a signal to the user which corresponds to a particular refill. Some suitable examples of oral care implements which can recognize a particular refill are described in U.S. Pat. Nos. 7,086,111; 7,207,080; and 7,024,717.

The interconnectivity between the neck 16, 616 and the handle region 12, 612 can be provided in any suitable manner. Some suitable embodiments are discussed with regard to U.S. Pat. Nos. 7,086,111, 7,207,080, and 7,024,717.

The toothbrush of the present invention may further comprise a timer. The timer may be positioned inside the toothbrush or may be disposed in a remote display. The timer may be configured to begin automatically such as with the application of a brushing force. Independently, or in conjunction with the application of brushing force, the timer may be activated by motion of the toothbrush. In such embodiments, the toothbrush may comprise accelerometers or other suitable device for measuring/monitoring the motion of the toothbrush. Such devices for monitoring/measuring the motion of the toothbrush are described in U.S. Patent Application Ser. No. 61/116,327, entitled, "PERSONAL CARE SYSTEMS, PRODUCTS, AND METHODS", filed on Nov. 20, 2008. An example of a suitable timer is a 555 timer integrated circuit available from many electronics stores where integrated circuits are sold.

The toothbrush of the present invention may further comprise a power source as discussed previously. The power source may be any suitable element which can provide power to the toothbrush. A suitable example includes batteries. The battery may be sized in order to minimize the amount of real estate required inside the toothbrush. For example, where the output source 650 consists of a light emitting element or vibratory motor (used for signaling the user and not vibrating the cleaning elements of the head and/or movement of the head) the power source may be sized relatively small, e.g. smaller than a triple A battery. In such embodiments, the vibratory device may be relatively small. The battery may be rechargeable or may be disposable. Additionally, a plurality of batteries may be utilized. In some embodiments, the power source may include alternating current power as provided by a utility company to a residence. Other suitable power sources are described in U.S. patent application Ser. No. 12/102,881, filed on Apr. 15, 2008, and entitled, "Personal Care Products and Methods".

In some embodiments, a user operated switch may be provided which can allow the user to control when pressure indication begins as well as when the timer begins. The switch (shown may be in electrical communication with the power source and the output signal element and/or the timer.

The handle region, e.g. 12, 612, may be constructed of any suitable material. Some examples include polypropylene, nylon, high density polyethylene, other moldable stable polymers, the like, and/or combinations thereof. In some embodiments, the handle region 12, 612, the neck 16, 616 and/or the head 14, 614 may be formed from a first material and include recesses, channels, grooves, for receiving a second material which is different from the first. For example, the handle may include an elastomeric grip feature or a plurality of elastomeric grip features. The elastomers among the plurality of elastomeric grip features may be similar materials or may be different materials, e.g. color, hardness, combinations thereof or the like.

The elastomeric grip features of the handle may be utilized to overmold, at least in part, a portion of the timer, output signaling element, processor, cap, and/or power source. In such embodiments, these components may be in electrical communication via wiring which can similarly be overmolded. The elastomeric grip features may include portions which are positioned for gripping by the palm of the user and/or portions which are positioned for gripping by the thumb and index finger of the user. These elastomeric grip features may be composed of the same material or may be different, e.g. color, shape, composition, hardness, the like, and/or combinations thereof.

Figure 14:
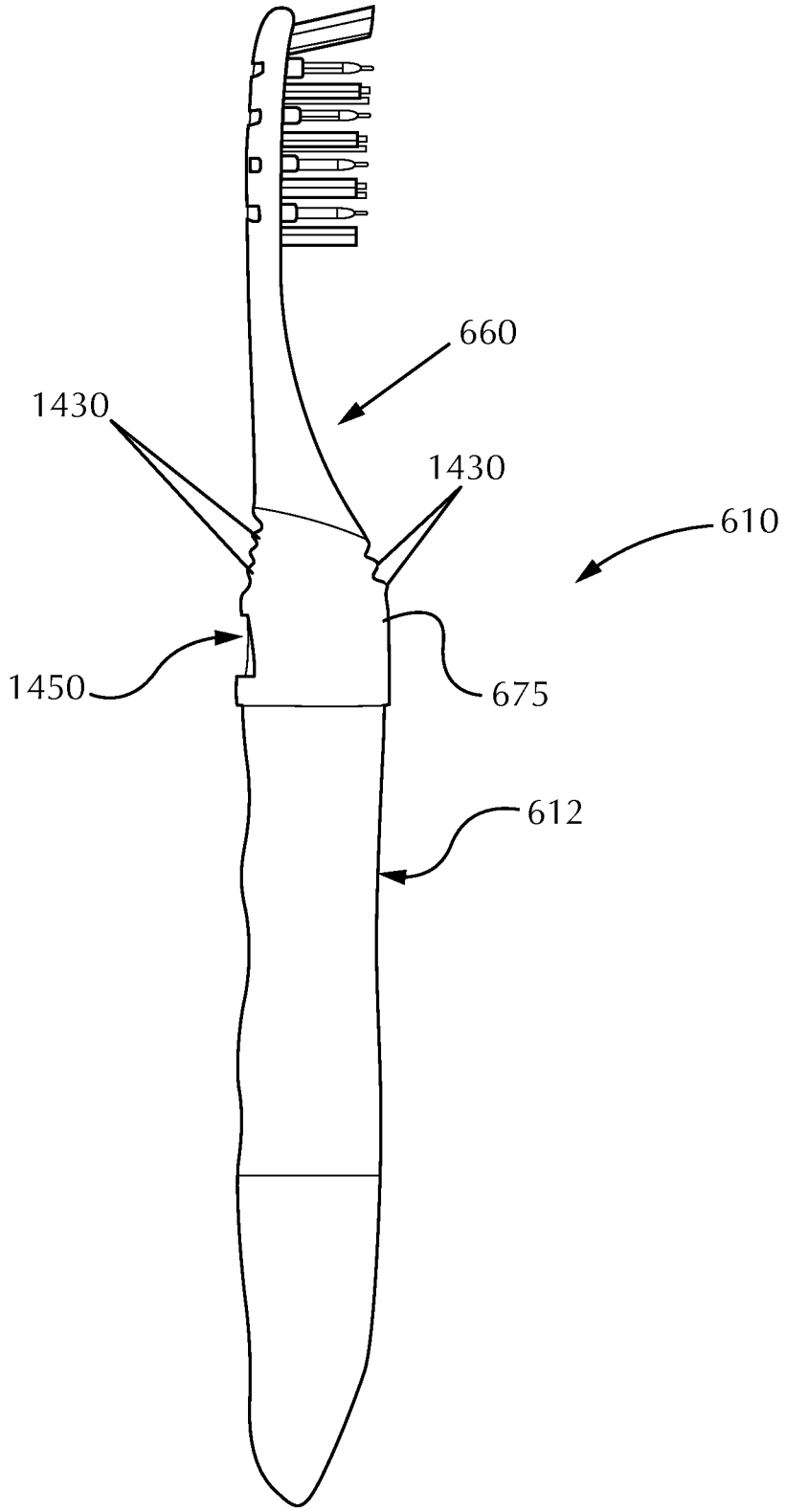
FIG. 14 is a side view showing a toothbrush constructed in accordance with the present invention.

In some embodiments, the forward cap 675 and/or the elastomer grip feature may include visual texture or features which provide a visual signal indicating the flexibility of the toothbrush sensor. For example, as shown in FIG. 14, the forward cap 675 may comprise rugosities 1430. The rugosities 1430 may provide visual communication to the consumer regarding the flexibility of the toothbrush. As shown, the forward cap 675 may be configured to include a opening 1450 which may allow the output source 650 (shown in FIG. 6A) to provide a visual signal to the consumer.

In some embodiments, the forward cap 675 may be transparent and/or translucent. For example, the output source 650 may comprise a white LED and the forward cap 675 may comprise a red translucent material. When the white LED is powered, the visual signal provided to the user may be a red visual cue.

The elastomeric grip features of the handle may be in communication with a channel, groove, and/or recess, in the neck via an external channel, groove, recess and/or via an internal channel, groove, recess. In some embodiments, the elastomeric grip features may be in communication with a channel, groove, and/or recess in the head via an internal channel, groove, and/or recess, and/or an external channel, groove, and/or recess. Alternatively, the grip features of the handle may be discrete elements from the features of the head and/or neck.

Additionally, as used herein, the term "cleaning elements" is used to refer to any suitable element which can be inserted into the oral cavity. Some suitable elements include bristle tufts, elastomeric massage elements, elastomeric cleaning elements, massage elements, tongue cleaners, soft tissue cleaners, hard surface cleaners, combinations thereof, and the like. The head 14, 614 may comprise a variety of cleaning elements. For example, the head 14, 614 may comprise bristles, abrasive elastomeric elements, elastomeric elements in a particular orientation or arrangement, e.g. pivoting fins, prophy cups, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/0080794.

The cleaning elements may be attached to the head 14, 614 in any suitable manner. Conventional methods include stapling, anchor free tufting, and injection mold tufting. For those cleaning elements that comprise an elastomer, these elements may be formed integral with one another, e.g. having an integral base portion and extending outward therefrom.

The head may comprise a soft tissue cleanser constructed of any suitable material. Some examples of suitable material include elastomeric materials; polypropylene, polyethylene, etc; the like, and/or combinations thereof. The soft tissue cleanser may comprise any suitable soft tissue cleansing elements. Some examples of such elements as well as configurations of soft tissues cleansers on a toothbrush are described in U.S. Patent Application Nos. 2006/0010628; 2005/0166344; 2005/0210612; 2006/0195995; 2008/0189888; 2006/0052806; 2004/0255416; 2005/0000049; 2005/0038461; 2004/0134007; 2006/0026784; 20070049956; 2008/0244849; 2005/0000043; 2007/140959; and U.S. Pat. Nos. 5,980,542; 6,402,768; and 6,102,923.

For those embodiments which include an elastomeric element on a first side of the head and an elastomeric element on a second side of the head (opposite the first), the elastomeric elements may be integrally formed via channels or gaps which extend through the material of the head. These channels or gaps can allow elastomeric material to flow through the head during an injection molding process such that both the elastomeric elements of the first side and the second side may be formed in one injection molding step.

In such embodiments including a soft tissue cleanser, consumer testing, robot testing, and/or clinical testing may be performed such that an upper threshold of force and a lower threshold of force can be established to provide feedback to the user with regard to the applied force to soft tissue, e.g. tongue. For those embodiments, including a soft tissue cleanser, the toothbrush may comprise an accelerometer or other suitable device for monitoring the orientation of the toothbrush. In combination with the applied force, e.g. brushing force, the processor can determine whether the soft tissue cleanser is being engaged or the cleaning elements are being engaged. The signal or a plurality of signals may be provided to the user as described herein. Providing feedback to the user regarding the applied force to soft tissue can assist the user in preventing damage to the soft tissue, e.g. papillae, while still achieving efficacious cleaning.

Test Method for Determining Applied Force for which Indication Occurs

Figure 13:
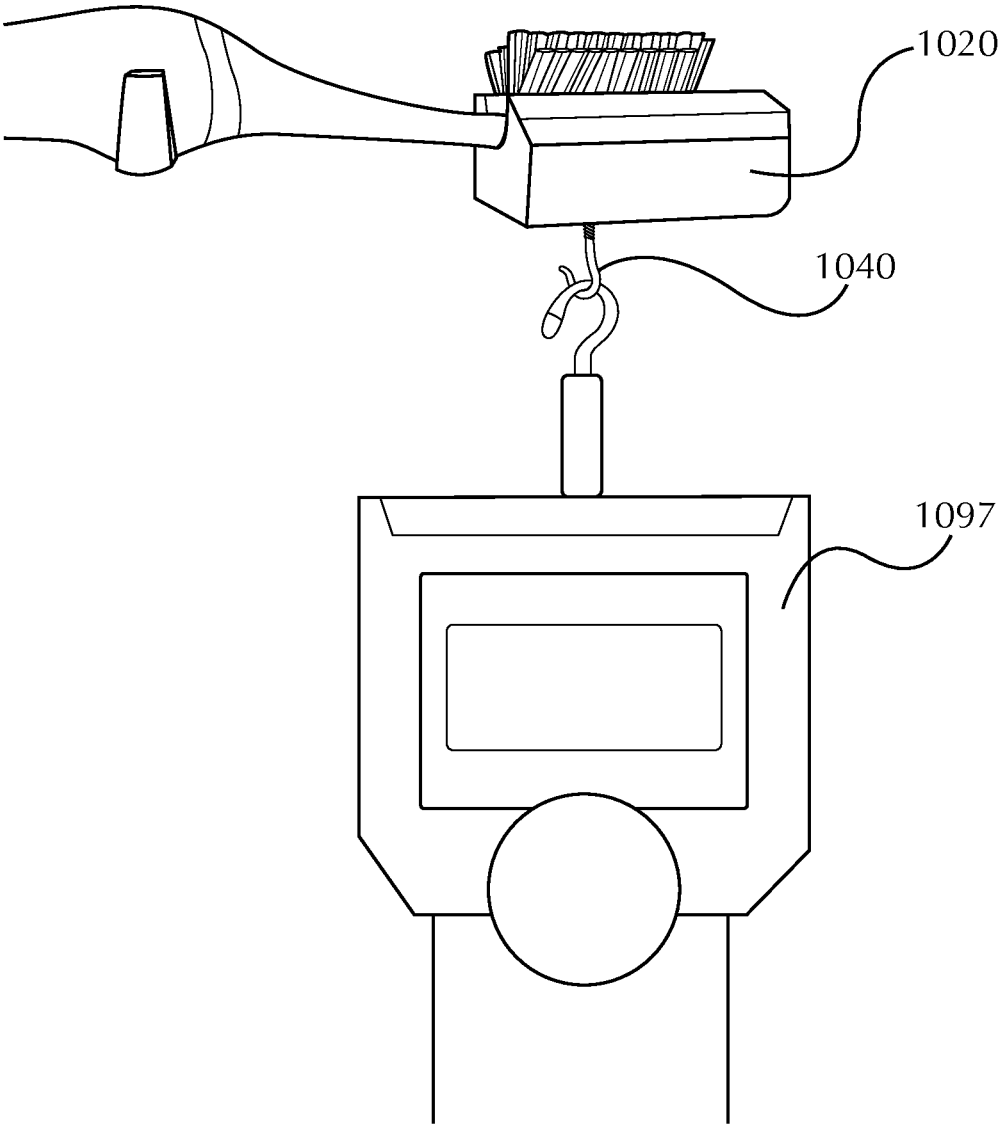
FIG. 13 is a close up view showing a force gauge attached to the pull block of FIGS. 11 and 12.

The test for determining an applied force for which indication occurs requires an adjustable frame and a force gauge 1097 (Shown in FIG. 13). The force gauge used should be capable of providing force readouts to at least two places to the right of a decimal (hundredths of a Newton). A suitable force gauge is available from Lutron Electronic Enterprise Co., Ltd. and available under model number FG-20KG. Prior to testing, the force gauge should be calibrated according to the manufacturer's recommendations or should be sent to the manufacturer for calibration.

Figure 10:
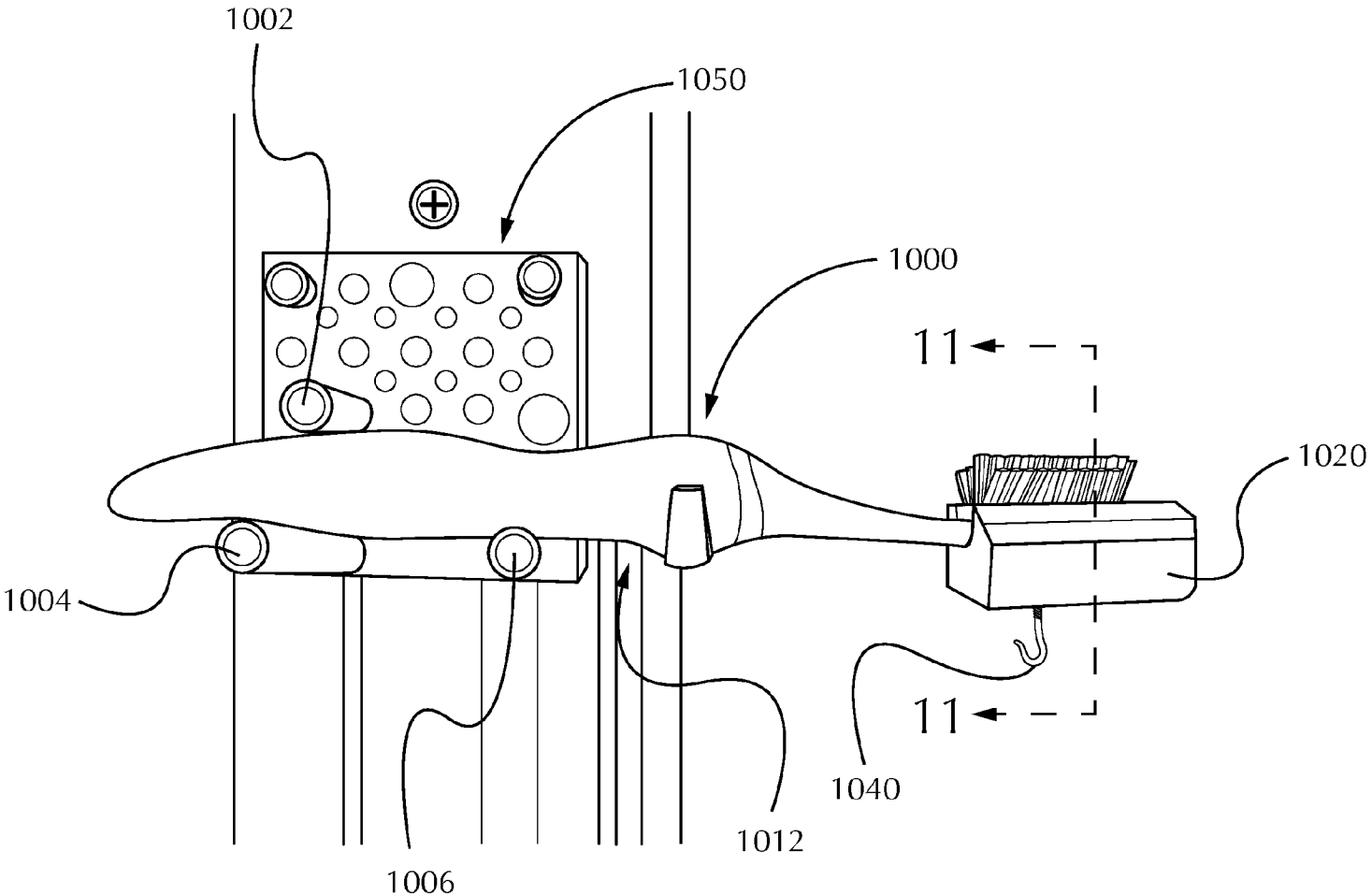
FIG. 10 shows a sample toothbrush fixed in a frame for testing.

As shown in FIG. 10, place a sample toothbrush 1000 into a three point fixture 1050 on the adjustable frame. The three point fixture 1050 will hold a handle region 1012 of the toothbrush 1000 via a first point 1002, a second point 1004, and a third point 1006. The points 1002, 1004, 1006, should be adjusted to preclude movement of the handle region 1012 during testing. Additionally, the toothbrush 1000 should be fixed in the fixture 1050, such that the head 1014 (shown in FIG. 11) is substantially parallel to a horizontal surface.

Figure 11:
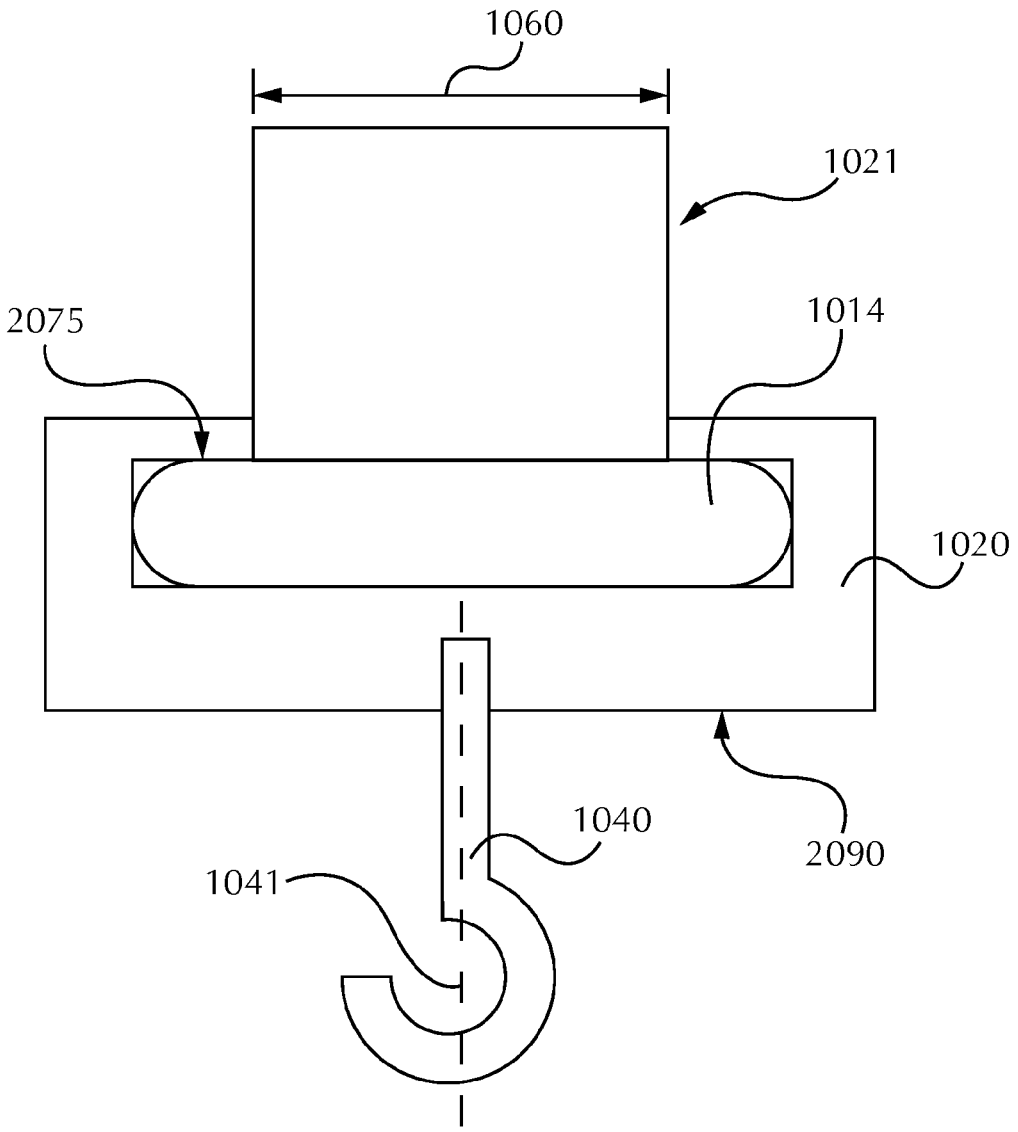
FIG. 11 is a cross sectional view showing the sample toothbrush of FIG. 10 and a pull block on a toothbrush head of the sample toothbrush.

A pull block 1020 is attached to a head 1014 (Shown in FIG. 11 and covered by the pull block 1020 in FIG. 10) of the toothbrush 1000. The pull block 1020 should be made of a rigid material which can allow a force of 10 Newtons to 15 Newtons to be applied to the head 1014 of the toothbrush 1000. As shown in FIG. 11, the pull block 1040 should engage a top surface 2075 of the head. No cleaning elements 1021 should be positioned between the top surface 2075 and the pull block 1020. If required, cleaning elements 1021 or a portion thereof, may be removed in order to allow the pull block 1020 to properly engage the top surface 2075 of the head 1014.

The pull block 1020 should be constructed such that a hook 1040 can extend from an underside 2090 of the pull block 1020. The hook 1040 can be attached in any suitable manner to the pull block 1020. The hook 1040 should be rigidly fixed to the pull block 1020, such that the hook 1040 does not move during testing. The hook 1040 should be positioned on the pull block 1020 such that a centerline 1041 of the hook 1040 bisects a distance 1060 of the cleaning elements 1021. The distance 1060 is the maximum straight line distance between cleaning elements which are furthest apart from one another along a lateral direction.

Figure 12:
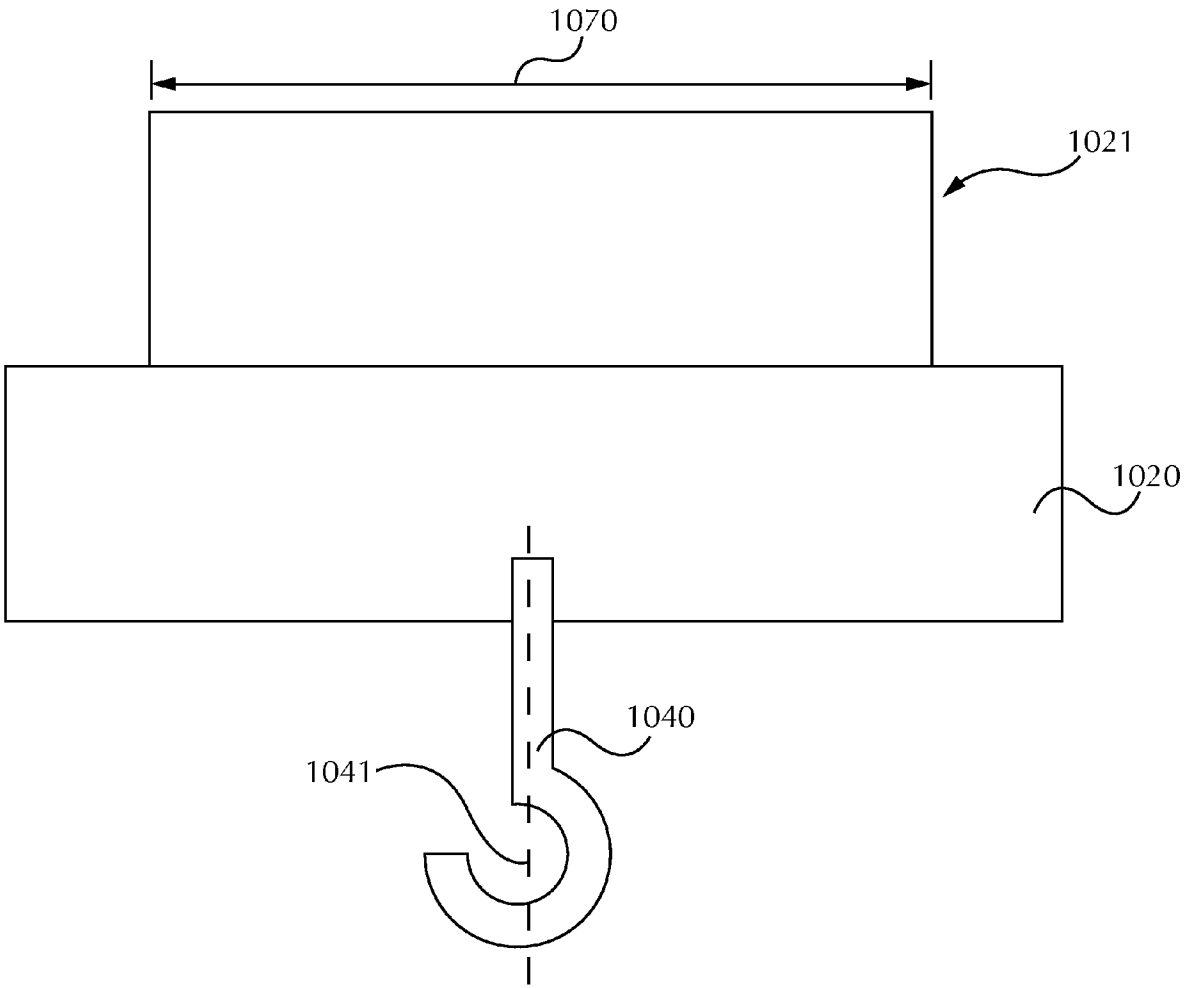
FIG. 12 is a close up view showing the sample toothbrush of FIG. 10 and the pull block on the toothbrush head of the sample toothbrush.

As shown in FIG. 12, the hook 1040 should be positioned on the pull block 1020 such that the centerline 1041 bisects a distance 1070 of the cleaning elements 1021. The distance 1070 is the maximum straight line distance between cleaning elements which are furthest apart from one another along a longitudinal direction.

Hang the force gauge 1097 from the hook 1040 of the pull block 1040. A lower end (not shown) of the force gauge 1097 should be fixed to the horizontal surface to which the head 1014 (shown in FIG. 11) of the toothbrush is substantially parallel. The force gauge 1097 is fixed to the horizontal surface such that the force gauge is plumb with the horizontal surface. Raise the adjustable frame until indication of a predetermined force is provided by the toothbrush 1000. Record the reading on the force gauge 1097. Repeat the test five times on additional samples of the toothbrush 1000.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A manual toothbrush comprising:

a handle region, including a first portion and a second portion, the handle region forming a hollow cavity;

a force sensor including a head, a neck and a distal portion, the force sensor being disposed within the hollow cavity; and an electrically powered element;

wherein the head includes a plurality of cleaning elements attached to the head, wherein the force sensor is pivotally connected to at least one of the first portion and the second portion; wherein the force sensor, the first portion and the second portion are a single, integral injection molded component; and wherein the electrically powered element is in electrical communication with the force sensor for providing an output signal to a user.

2. The toothbrush of claim 1, wherein the force sensor is connected to the first portion and/or the second portion via a spring.

3. The toothbrush of claim 2, wherein the spring is a torsion bar which is integrally formed with the force sensor.

4. The toothbrush of claim 2, wherein the spring is a torsion bar which is integrally formed with the first portion and/or the second portion.

5. The toothbrush of claim 1, further comprising a first spring attached to the force sensor and the first portion and a second spring attached to the force sensor and the second portion, wherein the first spring, the second spring, the force sensor, the first portion, and the second portion, are integrally formed.

6. The toothbrush of claim 5, wherein an axis of rotation of the force sensor is about the first spring and the second spring.

7. The toothbrush of claim 1, wherein the force sensor comprises a proximal end and a distal end, wherein the proximal end is disposed at the end of the head and wherein the distal end is opposite the proximal end, and wherein a first distance between the proximal end and a pivot axis of the force sensor is shorter than a second distance between the pivot axis and the distal end.

8. The toothbrush of claim 7, wherein the output signal is provided adjacent the distal end of the second portion.

9. The toothbrush of claim 7, wherein the first distance is less than about 90 percent of the second distance.

10. The toothbrush of claim 7, wherein the first distance is greater than about 10 percent of the second distance.

11. The toothbrush of claim 1, wherein the output signal comprises a first visual cue and a second visual cue, wherein the first visual cue provides an indication of an adequate amount of force being applied by the user.

12. The toothbrush of claim 11, wherein the second visual cue provides an indication that the force being applied by the user is too high.

13. The toothbrush of claim 1, wherein the output signal is provided by an LED.

* * * * *